US005402133A

United States Patent [19]

Merenda

[11] Patent Number: 5,402,133

[45] Date of Patent: Mar. 28, 1995

[54] SYNTHESIZER RADIATING SYSTEMS AND METHODS

[75] Inventor: Joseph T. Merenda, Northport, N.Y.

[73] Assignee: Hazeltine Corporation, Greenlawn, N.Y.

[21] Appl. No.: 891,345

[22] Filed: May 29, 1992

[51] Int. Cl.[6] ..... H01Q 1/26

[52] U.S. Cl. ..... 343/701; 333/103; 343/850; 343/876; 455/115; 327/365

[58] Field of Search ..... 343/701, 876, 850, 703; 328/113, 223; 307/246; 333/103, 104; 455/129, 107, 115; 323/282, 351; H01Q 1/26

[56] References Cited

U.S. PATENT DOCUMENTS

| | | | |
|---|---|---|---|
| 3,243,728 | 3/1966 | Brainerd et al. | 307/223 |
| 3,641,364 | 2/1972 | Rippel | 307/240 |
| 4,672,686 | 6/1987 | Raoux et al. | 455/129 X |

*Primary Examiner*—Donald Hajec
*Assistant Examiner*—Steven P. Wigmore
*Attorney, Agent, or Firm*—E. A. Onders; K. P. Robinson

[57] ABSTRACT

Synthesizer radiating systems providing efficient wideband operation incorporate a radiating element (20*a*), such as a loop, dipole or whip, which has dimensions which are small relative to wavelength in the radiated frequency band. Energy dissipation is substantially reduced by cycling stored energy back and forth between a radiating element (20*a*) having a first reactance and a storage element (22*a*) having the same or opposite reactance, in order to achieve energy efficiency along the lines of a narrowband tuned-circuit antenna. Wideband operation is achieved by synthesizing a representation of an input waveform (at 28) by actively controlling (30) solid-state switching devices (24), responsive to rate control and direction control parameters, which are interactive with the energy transferred between the opposite reactances. Higher efficiencies are achieved by bipolar circuits providing separate positive and negative energy transfer paths between a radiating element and a storage element. Systems as described provide relatively high radiated power levels with broadband operation and reduced power supply requirements, permitting provision of readily transportable units with small antennas for applications in which combinations of size, radiated power, bandwidth, power use and mobility are important.

34 Claims, 13 Drawing Sheets

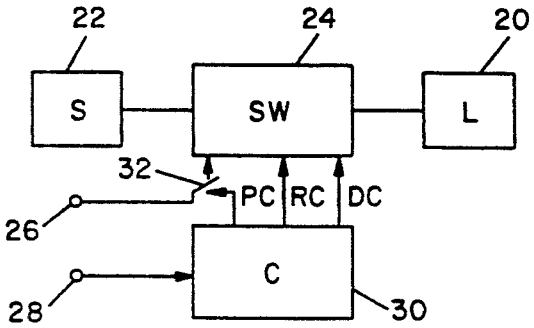
FIG. 5a
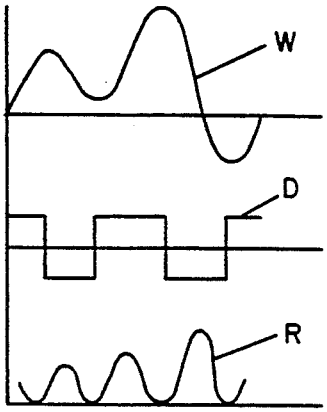
FIG. 5b
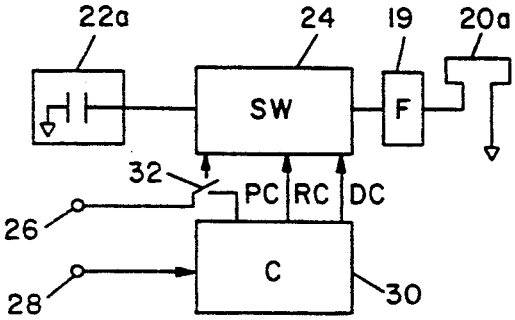
FIG. 5c
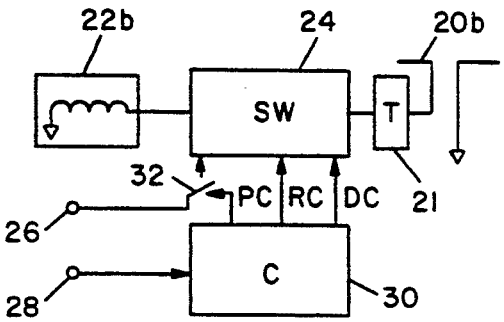
FIG. 5d
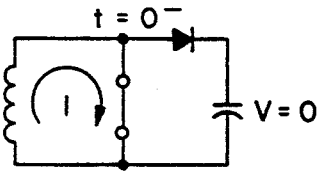
FIG. 6a (1)
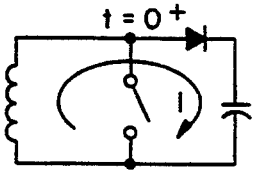
FIG. 6a (2)
L → C
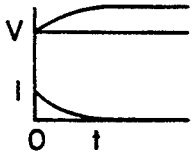
FIG. 6a (3)

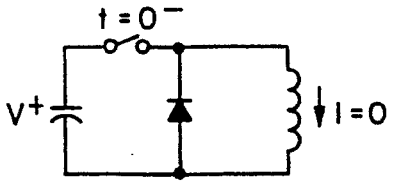
FIG. 6b (1)
C → L
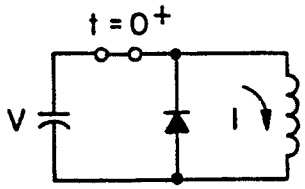
FIG. 6b (2)
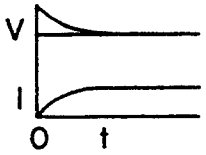
FIG. 6b(3)
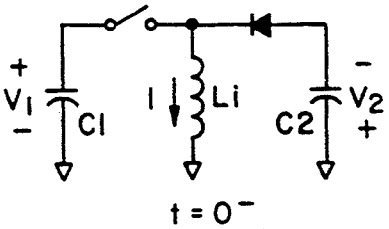
FIG. 6 c (1)
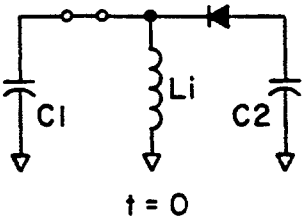
FIG. 6 c (2)
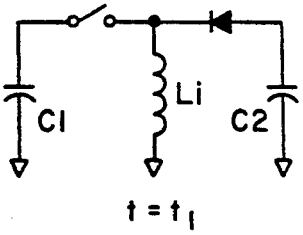
FIG. 6 c (3)
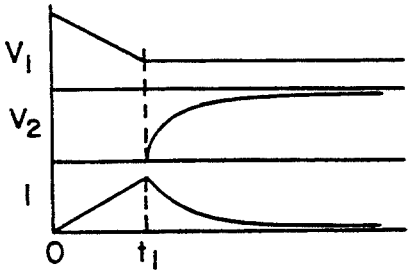
C → C
FIG. 6 c (4)
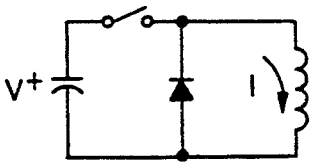
FIG. 7 a
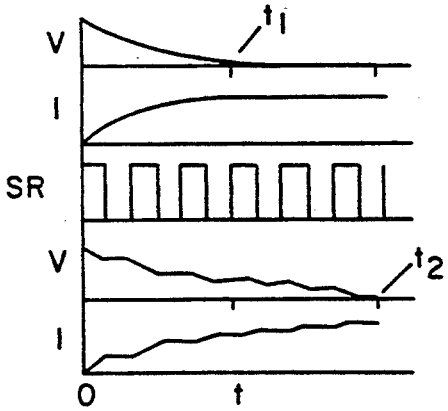
FIG. 7 b

| | | | | |
|---|---|---|---|---|
| D1A | O | C | O | O |
| DCA | C | O | O | O |
| D2A | M | M | O | O |
| RCA | M | M | O | O |
| D1B | O | O | O | C |
| DCB | O | O | C | O |
| D2B | O | O | M | M |
| RCB | O | O | M | M |

O = OPEN
C = CLOSED
M = MOD.

SYNTHESIZER RADIATING SYSTEMS AND METHODS

The present invention relates to radiating systems providing improved bandwidth, efficiency and waveform characteristics, particularly in small antenna applications, and more specifically to synthesizer radiating systems wherein improved operation is obtained by control of the direction, rate and level of energy transfer between a radiating element reactance and a counterpart energy storage reactance element. More generally, the invention enables the efficient transfer of energy to a high-Q load.

BACKGROUND OF THE INVENTION

Since the early days of radio, system designers of radiating systems have been encumbered by antenna size restrictions at operating frequencies below 30 MHz. Resonant antennas, which have a resistive input impedance, are prohibitively large, while smaller antennas are highly reactive and inhibit the transfer of power to radiation energy, especially when a wide bandwidth is required. The terms large and small are used to refer to antenna size relative to wavelength. It has been a long held belief of RF engineers that the bandwidth for efficient energy transfer from the source to a highly reactive load is inversely proportional to the Q of that load. That statement is true when the interface or matching network is restricted to passive components. As will be described, the present invention overcomes that limitation by use of active components to deliver broadband RF power to the real part of a highly reactive load. Although a specific application is the excitation of small antennas, the invention can be useful in other applications where it is desired to provide more effective energy coupling to a high-Q load of any type.

The equivalent circuits of common small antennas are shown in FIG. 1*a*, which represents a loop antenna, and FIG. 1*b*, which represents a dipole or whip-type monopole antenna. Antenna designers typically model an antenna with a fictitious resistor called the radiation resistance. Since the only element that can absorb or dissipate power is a resistive element the radiated power, or that absorbed by space, is modeled by the radiation resistance. The value of the radiation resistance and its associated reactance depends on the geometry of the antenna and its dimensions with respect to a wavelength. The ratio of reactance to resistance or Q is given by equation (1).

$$Q_{ANT} \cong 9/2\left(\frac{\lambda}{\pi L}\right)^3 \tag{1}$$

where λ is the wavelength and L is the physical size of the antenna. For example, a 10 foot antenna operating at 2 MHz has a Q of about 20,000.

Power transfer between a source and a high Q load is difficult because of voltage division between the load reactance and the small load resistance. In the above example, a power amplifier that provided an output at 20,000 volts would only produce 1 volt across the radiation resistance and result in a very small amount of radiated power.

A summary of possible approaches using existing technology is shown in FIGS. 2*a* and 2*b*. When high efficiency is desired, the narrowband approach of FIG. 2*a* can be used. High efficiency is achieved by use of a high-efficiency non-linear power amplifier A feeding a tuner T, which tunes the antenna by using the opposite type reactor in series with the antenna reactance to yield a net reactance of zero at resonance. The reactances can only cancel at one frequency, and the ½ power bandwidth, which occurs when the circuit's net reactance is equal to that of the resistance, is equal to 1/Q. With this approach, it is possible to use a non-linear, highly efficient (e.g., class C) amplifier because all higher harmonics caused by the non-linear distortion are filtered by the tuned circuit. In theory, if there were no losses associated with the tuning reactance, it would be possible to achieve 100% efficiency of power transfer at one frequency using this approach. In the aforementioned example at 2 MHz, the ½ power bandwidth would be only 100 Hertz.

When, using prior technology, it is desirable to radiate power over a wide instantaneous frequency bandwidth, the approach indicated in FIG. 2*b* can be used. This approach uses a linear power amplifier A with no tuning reactor. The amplifier could be either class A or the more efficient push-pull class B or class AB. The amplifier must be linear because no filtering of harmonics caused by distortion occurs in this circuit. The efficiency of this approach, using a class B push-pull amplifier, is approximately equal to 1/Q. Given the example of a 10-foot antenna at 2 MHz, a 1000 watt class B push-pull amplifier could deliver over a broad frequency range only 50 milliwatts to radiation.

Efficiency and bandwidth can be traded off using an intermediate approach. That is accomplished by resistive loading (placing a larger resistor in series with the radiation resistance.) The bandwidth is increased because the effective Q of the load is lowered, however, most of the power delivered to the load is dissipated in the series resistor, thereby decreasing efficiency. As a practical matter, almost all circuits have resistive loading which results from either loss in the tuning reactor, and/or, conductor losses in the antenna. If a tuned circuit Q is defined as the reactance divided by all loss resistance, then efficiency and bandwidth can be defined by equations (2) and (3)

$$\text{Efficiency} = \frac{Q_c}{Q_{ANT} + Q_c} \tag{2}$$

$$\text{Bandwidth} = 1/Q_c \tag{3}$$

where $Q_c$ is the tuned circuit Q. It is assumed that $Q_c << Q_A$. In a practical antenna, the highest achievable circuit Q at 2 MHz might be about 500. In the previous example, the bandwidth would be 4 KHz, while the efficiency would be 0.025 (1000 W amplifier delivers 25 W radiation).

In the case of the broadband linear amplifier, most of the power delivered by the DC power source is dissipated by the amplifier output device. Instantaneous power dissipation by any device is defined as the voltage across the device multiplied by the current flowing through it at the same instant in time. The load line of each device in a class B push-pull amplifier is shown in FIG. 3, wherein I represents the device output current and V represents the device voltage. As shown, the CP lines represent control parameter characteristics of the amplifier, $V_Q$ is the bias voltage, $V_p$ is the peak voltage across the device, $I_p$ is the peak device current and L is the load line. The circular load line L occurs when the amplifier drives a reactive load (voltage and current waveforms in quadrature). Throughout most of the cycle, power is dissipated because both voltage and current occur simultaneously in the device. Average dissipation can be computed through integration of the instantaneous power dissipation over ½ cycle. The result of that integration is:

$$P = \frac{2}{\pi} \frac{V_Q^2}{X_{LOAD}} \tag{4}$$

where $V_Q$ is the quiescent bias voltage and $X_L$ is the reactance of the load.

If A is the peak amplitude of the sinusoidal voltage waveform, then $V_Q = A$ is the optimum bias, considering power dissipation.

$$P = \frac{2}{\pi} \frac{A^2}{X_L} \tag{5}$$

The output power delivered to the real part of the load is found by voltage division between the load reactance and resistance.

$$V_{OUT} = A\left(\frac{R}{X_L}\right) \tag{6}$$

$$P_{OUT} = 1/2 \frac{V_{OUT}^2}{R} = 1/2 \frac{A^2}{QX_L} \tag{7}$$

Efficiency is approximately equal to the power delivered to the load divided by that dissipated in the source.

$$\text{Efficiency} = \frac{1/2\, A^2/QX_L}{(2/\pi)(A^2/X_L)} = \frac{\pi}{4}\left(\frac{1}{Q}\right) \tag{8}$$

It can be shown that efficiency in this antenna context is limited by conservation of energy. Amplifier output devices that operate in a switch mode (ON: High Current, Voltage=0; OFF: High Voltage, Current=0) theoretically dissipate no power because the instantaneous multiplication of voltage and current is always zero. Class D and E amplifiers use this principle to achieve high efficiency. Such amplifiers are intended for use with resistive loads and use intermediate filter networks in order to eliminate the harmonics that are generated by the switch. The filter network transforms the square-wave type switch output to the desired sinusoidal output waveform.

Attempts have been made in the past to improve the efficiency of the linear amp/reactive antenna combination by using switchmode output devices. As opposed to the class D and class E amplifiers where the switch frequency is equal to the output frequency, a switchmode arrangement may use a switch frequency that is faster than the desired output frequency. A low pass filter can be placed between the amplifier and load. The filter, in effect, averages the switch output voltage. Therefore, it is possible to vary the filter output voltage by adjusting the ratio of ON to OFF times of the switch. This approach is wideband up to a reasonable percentage of the low pass filter cutoff. A possible wideband amplifier/small antenna approach could use this technique in order to synthesize the high voltage at the input terminals of a reactive antenna. However, it has been found that only insignificant efficiency improvements are possible. One explanation addresses the effect of the low pass filter input impedance when driving a reactive load. The input impedance is always reactive at the switch mode frequency. Therefore, the switch current and voltage must be in quadrature (instead of antiphase) and instantaneous power is always dissipated.

All known attempts at modifying such a filter in order to improve efficiency have been unsuccessful. The result can be attributed to the fundamental principle of conservation of energy. FIG. 4 shows the basic circuit and its waveforms. As shown, a small antenna is connected across the output terminals of a power source P. Since the source output voltage is much larger than $V_o$ across the resistive part of the load L, nearly all the input voltage, or current, is across or through the reactance. Any reactor is an energy storage device with the following amounts of energy stored:

$$E = \tfrac{1}{2} CV^2 \text{ (capacitor)} \quad E = \tfrac{1}{2} LI^2 \text{ (inductor)} \tag{9}$$

As the waveform cycles through its periodic variation, there must be a large peak of stored energy in the reactor. When the waveform cycles back through zero, the stored energy will be equal to zero. Conservation of energy mandates that the peak stored energy cannot disappear. It must either be transferred to another storage media, or dissipated. In the case of the broadband amplifier, where there is no other reactor for storage,it must be dissipated by the power source. In the case of a narrowband, tuned amplifier, energy is transferred to the tuning reactor, which is of the opposite type of reactance from the antenna reactor. When one reactance has peak energy, the other has zero and at intermediate times, the energy is distributed between the two reactors. At all times, the total circuit energy is equal to the peak value, as computed by the peak voltage or current that must be imposed on the antenna load. No energy is dissipated in this ideal case. It is transferred back and forth at the resonant frequency of the tuned circuit. Therefore, this approach is very efficient, but provides only very narrowband operation.

So far as is known, no prior broadband approach has effectively incorporated another reactor for storage of transferred energy. Therefore, the output devices have dissipated the peak energy at a rate of twice each cycle. A limit on the efficiency of a broadband amplifier can be computed from energy considerations. Since power is the rate of energy dissipation, average power can be found by integrating the rate of energy dissipation over a cycle of the output waveform. The result of that computation, where $P_D$ is the dissipated power, is:

$$P_D = \frac{Q}{\pi} P_{OUT} \tag{10}$$

A comparison with the class B push-pull amplifier shows that this type of circuit can theoretically perform within 25% (6 dB) of the maximum achievable efficiency.

It is, therefore, an object of this invention to provide radiating systems able to achieve both high efficiency and broad-band operation in conjunction with a high Q circuit and, more particularly, in combination with a small antenna.

It is a further object to provide new forms of synthesizer radiating systems and, more particularly, such systems having a transmit antenna which is interactive with a waveform synthesizer amplifier providing active control of one or more of the direction, rate and level of energy transferred between a radiating element with a reactive characteristic and an energy storage element with either an opposite or a similar reactive characteristic.

Additional objectives are to provide new and improved radiating systems which avoid one or more limitations of prior systems, as well as systems which achieve wider bandwidth operation or improved efficiency, or both, in the coupling of energy to a high-Q load, which may be a radiating element.

SUMMARY OF THE INVENTION

In accordance with the present invention a synthesizer radiating system, employing active control of energy transferred back and forth between an antenna reactance and a storage reactance, utilizes antenna means, including a radiating element having a first reactive characteristic, for radiating signals. The system also has energy storage means, including a storage element having a second reactive characteristic, for providing energy to and receiving energy from the radiating element. Switching means, coupled between the antenna means and the energy storage means, control the rate, or rate and direction, of transfer of energy transferred back and forth between the storage element and the radiating element. Energy input means are provided for coupling input energy from a source of electrical energy and signal input means are provided for coupling input signals representative of a waveform to be radiated. The synthesizer radiating system also includes controller means, coupled to the switching means and signal input means, for providing control signals to the switching means in response to input signals for controlling the rate, or rate and direction, of transfer of such energy transferred back and forth between the storage element and the radiating element. As a result, signals having a variety of waveforms may be radiated with reduced power dissipation as a result of conservation of energy by the transfer back and forth between the radiating and storage elements.

Further in accordance with the invention, in a synthesizer radiating system as described above, the radiating element may have a primarily inductive reactance or a primarily capacitive reactance and the storage element may have a reactance which is the same as, or different from, the radiating element reactance. With such use of like or opposite reactances, the system may be arranged as either a unipolar circuit or as a bipolar circuit. In the latter case, separate paths are independently provided for positive and negative energy transfer, providing increased efficiency, albeit with increased circuit complexity.

In systems in accordance with the invention, the controller means may include a first pulse width modulator for controlling the switch closure duty cycle of a rate control switching device so that the switch closure duty cycle of such rate control switching device is proportional to the magnitude of a derivative of input signal current over time when energy is transferred from the energy storage element to the radiating element, and a second pulse width modulator for controlling the switch open duty cycle of such rate control switching device so that the switch open duty cycle of the rate control switching device is proportional to the magnitude of a derivative of input signal current over time when energy is transferred from the radiating element to the energy storage element. The switching means may also include a direction control switching device for controlling the direction of transfer of energy transferred back and forth between the storage element and the radiating element in response to a direction control switching signal representative of reversals in the direction of change of an input signal waveform.

Also in accordance with the invention, a method for bipolar coupling of signals to an antenna reactance, employing signal synthesis using energy transferred back and forth between said antenna reactance and a storage reactance, comprises the steps of:

(a) storing energy in a storage reactance;
(b) transferring a portion of energy stored in step (a) to an antenna reactance via a first actively controlled switching device;
(c) controlling the rate of transfer of energy in step (b) by controlling the first switching device in response to an input signal in order to synthesize a signal to be radiated;
(d) transferring back to the storage reactance, via a second actively controlled switching device, a portion of the energy transferred to the antenna reactance in step (b);
(e) controlling the rate of transfer of energy in step (d) by controlling the second switching device;
(f) repeating steps (b) through (e) as desired; and
(g) storing additional energy in the storage device when appropriate to provide desired replenishment of energy dissipated.

For a better understanding of the present invention, as well as other and further objects and features, reference is made to the following description taken in conjunction with the accompanying drawings and its scope will be pointed out in the appended claims.

BRIEF DESCRIPTION OF THE DRAWINGS

FIG. 5*a* is a simplified block diagram of a synthesizer radiating system in accordance with the invention and FIG. 5*b* shows related output waveform, energy direction control switching and energy rate control switching curves.

FIG. 5*c* illustrates the FIG. 5*a* system arranged for operation with a loop element having inductive reactance and FIG. 5*d* illustrates the FIG. 5*a* system arranged for operation with a dipole having capacitive reactance.

FIG. 6*a* (1), (2) and (3) and FIG. 6*b* (1), (2) and (3) are useful in describing elementary unidirectional energy transfer between opposite reactances and FIG. 6*c* (1), (2), (3) and (4) relate to energy transfer between like reactances.

FIG. 7*a* and FIG. 7*b* are useful in describing the effects of a slowing of the rate of energy transfer.

DESCRIPTION OF THE INVENTION

Figure 1A:
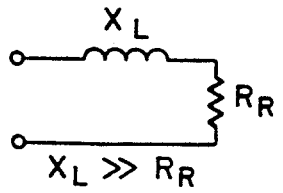
FIG. 1*a* and FIG. 1*b* are equivalent circuits of prior small inductive and capacitive antennas, respectively.
Figure 1B:
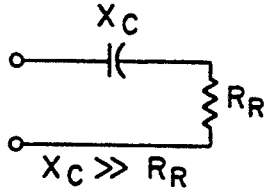
Figure 2A:
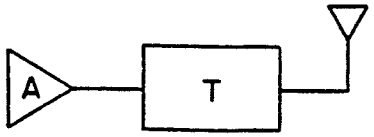
FIG. 2*a* represents a high efficiency/narrowband antenna circuit and FIG. 2*b* represents a low efficiency/wideband arrangement.
Figure 2B:
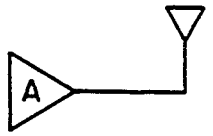
Figure 3:
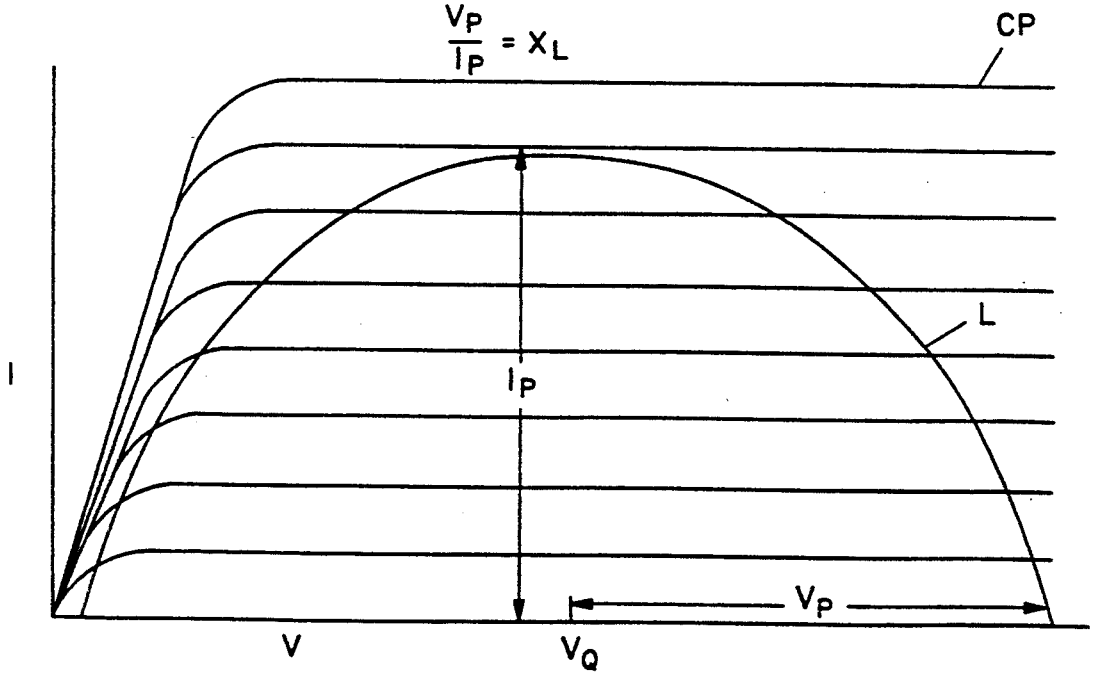
FIG. 3 illustrates control parameter characteristics and the load line of each active element of a class B push-pull amplifier.
Figure 4:
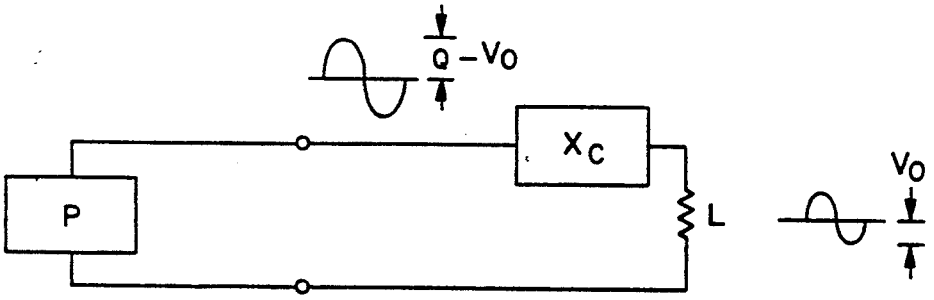
FIG. 4 illustrates the limited output power efficiency of a linear amplifier/reactive antenna circuit.

A simplified block diagram of a synthesizer radiating system in accordance with the invention is shown in FIG. 5*a*. As shown, the radiating system includes a high-Q load 20, which may be antenna means, including a radiating element having a first reactive characteristic, for radiating signals. Thus, depending upon the application, load 20 can typically comprise a known-type of loop antenna, having an inductive reactance, or a dipole or whip antenna, having a capacitive reactance.

The FIG. 5*a* embodiment also includes energy storage means 22, including a storage device having a second reactive characteristic differing from the first reactive characteristic, for receiving energy from and returning energy to the radiating element of load 20. As will be further explained, if load 20 comprises a loop antenna, for example, and thus is characterized by an inductive reactance, the differing second reactive characteristic would be provided by storage means 22 comprising a storage device, such as a capacitor, with a capacitive reactance. This configuration is illustrated in FIG. 5*c*. Correspondingly, if the first reactive characteristic of load 20 is capacitive, storage means 22 will have a second reactive characteristic of an opposite or inductive nature. This configuration is illustrated in FIG. 5*d*. The relative magnitudes and relationships of the two different reactances will be discussed further below.

As illustrated, FIG. 5*c* also has a low pass or band reject filter 19 inserted in series with the loop antenna 20*a*. Filter 19 may be included as appropriate in order to reduce spurious radiation at the switching frequency of switch RC, as will be further discussed with reference to FIGS. 10 and 11.

The synthesizer radiating system of FIG. 5*a* further includes switching means 24, first input means, shown as terminal 26, for coupling input energy, second input means, shown as terminal 28, for coupling input signals representative of a waveform to be radiated, and controller means 30. Switching means 24 desirably has the form of active switching circuits capable of controlling the direction or rate, or both, of energy transfer between a reactive radiating element in load 20 and a storage device of opposite reactive characteristic in storage means 22. Switching means 24 achieves this direction and rate control, over energy transferred back and forth in both directions between units 20 and 22, in response to rate control (RC) and direction control (DC) signals provided by controller 30. Input terminal 26 is arranged to provide a supply of D.C. power, in this example, by connection to an appropriate source of electrical energy. Input terminal 28 is arranged to receive an input signal waveform from a suitable source of signals representing message, data or other informational content to be transmitted via a radiated signal.

As illustrated in FIG. 5*a*, controller 30 receives the input signals via input terminal 28 and provides RC and DC switching signals to switching means 24 to enable the switching means to control the rate, or rate and direction, of energy transfer back and forth between units 20 and 22, in response to the input signals, which are representative of a waveform to be radiated. In this embodiment, controller 30 is also connected to a switch or control device 32, which couples between the power input terminal 26 and switching means 24. By control of switching device 32, controller 30 controls the input of energy from the outside source and thereby controls the level of the energy transferred between load 20 and storage means 22. As will be explained in greater detail with reference to particular circuit arrangements and details of operation, controller 30 in combination with switching means 24 are thereby enabled to control the synthesis and radiation of a desired waveform with a wide frequency bandwidth capability and high energy efficiency, as compared to prior systems. As will be appreciated from description of the invention, the word "synthesizer" is used to describe the providing of a desired output waveform by a combination of incremental portions representative of values of an input waveform at different time intervals.

Addressing now, more particularly, the operation of synthesizer radiating systems utilizing the invention, it will be seen that the invention (1) achieves energy efficiency by transferring energy between an antenna element and another reactive element, instead of dissipating such energy, and (2) achieves broad-band operation by actively controlling the direction and rate of energy transfer. The invention thus achieves efficiency similar to the efficiency of the above-described tuned circuit approach, but without the narrowband limitation, and achieves bandwidth capabilities similar to the resistive load approach, but without the resistive energy dissipation.

The controller 30 produces the desired output waveform by providing switching signals for adjusting the rate and direction of energy transfer between the two reactors (storage and load). If V(t) is the desired output waveform as supplied to terminal 28 and dV(t)/dt is its derivative, then the sign of the derivative can be used for direction control purposes and the magnitude of the derivative can be used for rate control purposes. FIG. 5b illustrates the basic concept, with W representing the desired output waveform, D representing the direction switching control signal and R representing the rate switching control signal. As time progresses, some of the stored energy will be dissipated in the real part of the load, or in inherent losses that are associated with the active circuit or storage reactor. As will be described, in this embodiment the controller monitors the total energy and adds energy from the prime power source as warranted. Without circuit losses, this circuit could be 100% efficient (all energy supplied by the prime power source would be delivered to the antenna load). This circuit also enables very wideband operation.

Two elementary unidirectional energy transfer circuits are shown in FIGS. 6a and 6b. In FIG. 6a (1), energy is stored in current that flows through the inductor. In the absence of circuit losses, the current would continue to flow around the loop through the closed switch forever. When the switch opens as shown in FIG. 6a (2), the inductor current must be continuous. It flows through the diode and into the capacitor, charging it up. Eventually, all the inductive energy is transferred to the capacitor, the current decays to zero, and the capacitor voltage asymptotically approaches a value equal to $\sqrt{L/C}$ I where I was the initial inductor current as shown in FIG. 6a (3). The diode drop is ignored in the ideal circuit. The diode prevents the capacitor from discharging through the inductor and the circuit from oscillating back and forth. In FIG. 6b (1), energy is initially stored in the capacitor. When the switch closes as shown in FIG. 6b (3), the capacitor discharges through the inductor. Eventually, the capacitor voltage decays to zero while the inductor current asymptotically approaches $\sqrt{C/L}$ V where V was the initial capacitor voltage, as shown in FIG. 6b (3). In the ideal circuit, the inductor current continues to flow around the loop through the diode forever. In both circuits, the initial and final stored energies are equal.

The rate of energy transfer can be slowed down by cycling the switch in either circuit. FIG. 6a illustrates inductor to capacitor energy transfer and FIG. 6b illustrates capacitor to inductor energy transfer. In the FIG. 6a circuit, if the switch is closed while energy is partially distributed between the L and C, energy levels will remain at the distribution levels immediately prior to the switch closure. Similarly, energy transfer can be interrupted in the FIG. 6b circuit by opening the switch. The transfer can be restarted by recycling the switch. It will now be apparent that the average rate of energy transfer can be controlled by the duty cycle of switch closure as the switch is cycled between its two states. The effects of a slowing of the rate of energy transfer is demonstrated in FIG. 7a, and 7b where the switch is cycled at a 50% duty factor. The result is that the rate of transfer is slowed by a factor of two. Thus, in FIG. 7b the upper curve V, representing the case in which the switch is closed continuously after time t=o, decreases to a reference level after time t1. In comparison, the lower curve V, representing the case in which the switch is initially closed and opened and closed as indicated at SR, does not decrease to the same reference level until time t2. It thereby can be appreciated that the switching rate must be much faster than the natural decay rate of the circuit and that, if fast enough, the voltage and current waveforms can be caused to approximate a smooth function. In this way, the rate of energy transfer can be controlled, while still producing a close approximation of a desired waveform.

In an alternative embodiment of the invention, the basic circuit may be arranged so that energy is transferred from a first reactance to a like reactance, rather than between two elements of opposite reactance. A capacitance to capacitance, or C to C, circuit is conceptually illustrated in FIG. 6c. In this arrangement an intermediate opposite reactance inductive element Li is incorporated, not for use as the basic energy storage element, but as an interim element utilized in the transfer of energy between the two primary capacitive elements C1 and C2. The value of inductor Li in FIG. 6c may be substantially smaller than the value required for use as a storage reactance as in the C to L embodiment previously described. In the FIG. 6c type circuit, energy transfer requires at least two movements of the switch, depending on the switching rate and actual inductor value. The rate of energy transfer is controlled by the switch duty cycle.

In the circuit shown at the left in FIG. 6c, (1) the energy is initially stored in capacitor C1 with the switch open. At time t=o the switch is closed and C1 begins to discharge through the inductor Li (at center in FIG. 6c (3)). The voltage on C1 is always positive, causing the diode to be back biased. Before capacitor C1 is completely discharged, the switch is opened at time t1 (at right in FIG. 6c(3)). Since the inductor current must be continuous, with the switch open the current must flow around the loop through the diode and capacitor C2. Capacitor C2 begins to charge up to a negative voltage and continues to charge until the current flow in the inductor is reduced to zero. Since the inductor Li has a small inductance, the charge time of C2 is very short. After one cycle of switch closure and opening, the voltage on C2 can be determined based upon conservation of energy, whereby the energies stored in C1 and C2 must equal the energy initially stored in capacitor C1. Additional energy can then be transferred from C1 to C2 by progressing through another cycle of switch closure and opening. Transfer time can be adjusted by adjusting the time the switch is closed and/or the time between close/open cycles. With an understanding of the intermediate storage of energy in an interim element such as inductor Li, it will be appreciated that C to C energy transfer or L to L energy transfer (i.e., substituting an interim capacitor Ci) can be provided in systems in accordance with the invention, as alternatives to C to L and L to C transfer as previously described.

BASIC SYSTEM

Figure 8A:
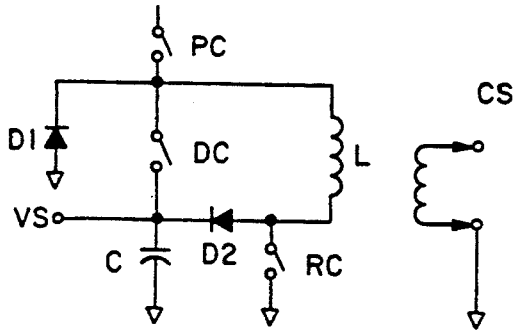
FIG. 8*a* illustrates application of the invention to a unipolar circuit including an inductive radiating element.

Application of the invention to a circuit which combines transfer circuits in both directions using two switches is shown in FIG. 8a. This circuit functions as an active loop antenna where the loop antenna L is the high Q inductive load and a capacitor C is used as the storage reactor. It should be noted that, alternatively, the load could be a small whip antenna having capacitive reactance, with an inductor provided as the energy storage means. The FIG. 8a circuit uses two RF type switching transistors, shown as switches RC and DC, for rate and direction control, respectively. Because the devices are operated in a switch mode, efficient operation is obtained since, in theory, no instantaneous power is ever dissipated by such devices. A slower switching device, shown as power control switch PC, can be used to add energy to the circuit from the power supply as energy is dissipated. The voltage and current sensor terminals VS and CS, respectively, are used to monitor and calculate the total amount of stored energy at any instant in time, while a feedback control circuit is used to maintain the total energy at a preset value through use of the power control switch PC.

Figure 8B:
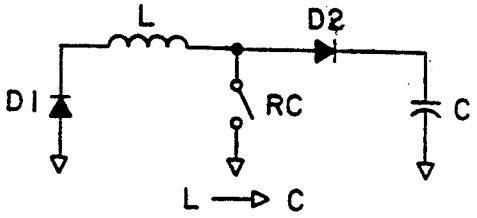
FIG. 8*b* and FIG. 8*c* are useful in describing L to C and C to L energy transfer, respectively, in the FIG. 8*a* circuit.

In the FIG. 8*a* circuit, when the direction control switch is open, energy can be transferred from current through the inductor L to voltage across the capacitor C, as illustrated by the L to C energy transfer diagram of FIG. 8*b*. With the rate control switch closed, current flows from ground, through diode D1 and L, and back to ground through the rate control switch RC. In the absence of circuit losses, the current would continue to flow indefinitely. When the rate control switch RC is opened, the inductor current, which must remain continuous, flows through diode D2 and charges up the capacitor C. The rate at which C charges up is determined by the switch open duty cycle of the switch RC. The capacitor will charge up at the maximum rate when the switch is continuously open. The charging time constant is directly proportional to the switch open duty cycle of the rate control switch RC.

Figure 8C:
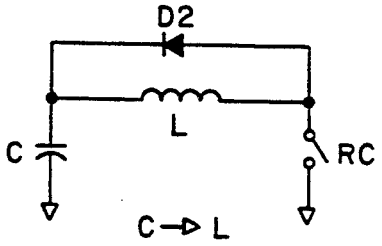

When the direction control switch DC of FIG. 8*a* is closed, energy can be transferred from voltage across the capacitor to current through the inductor, as shown in the C to L energy transfer diagram of FIG. 8*c*. Diode D1 is always back biased and is, therefore, out of the circuit. When the rate control switch RC is closed, the capacitor C will discharge through L, gradually building up the current through L. If the rate control switch is opened, the capacitor will maintain its voltage while the inductor current flows in a loop through diode D2. In this C to L direction transfer mode, the rate is controlled by the switch closure duty cycle of switch RC. The maximum rate of energy transfer occurs when the switch RC is continuously closed. Its operation is the inverse of that in the other direction transfer mode (L to C).

It should be noted that, in either direction, charge or discharge is exponential. Therefore, the rate of voltage or current rise is not constant for a given rate control duty cycle. In order to maintain a constant rate of charging (ramp in voltage or current), it is necessary to appropriately modulate the duty cycle as charging progresses. The correct duty cycle, for a given set of circuit conditions and desired rate, can be found from the fundamental equations.

$$V_L = L\frac{di}{dt} \tag{11}$$

$$I_c = C\frac{dV}{dt} \tag{12}$$

For specific charging rates $$\left(\frac{di}{dt} \text{ or } \frac{dV}{dt}\right),$$

the correct duty cycle can be found from the following equations:

$$\text{DutyCycle}_{CLOSURE} = \frac{L}{V}\left(\frac{di}{dt}\right) \tag{13}$$

$$\text{DutyCycle}_{OPEN} = \frac{C}{I}\left(\frac{dV}{dt}\right) = \frac{L}{V}\left(\frac{di}{dt}\right) \tag{14}$$

In the above circuit, it is possible to use the capacitor voltage as a control parameter. In the C to L transfer mode, the capacitor and inductor voltages are interchangeable because L and C are in parallel during transfer (rate control switch closed). Similarly, during the L to C transfer, the voltages are interchangeable because of the parallel connection during transfer (rate control switch open). If there is interest in one parameter (e.g., current through loop), it is possible to compute the correct duty cycle at any time by differentiating the desired inductor current waveform in order to obtain the desired rate, by simultaneously monitoring the capacitor voltage, and by computing the duty cycles using equations (13) and (14).

Figure 8D:
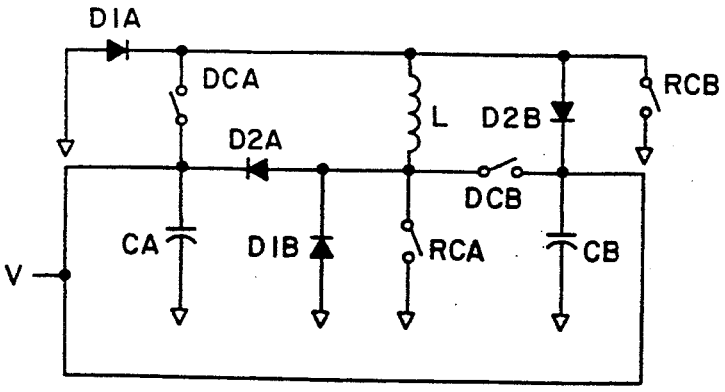
FIG. 8*d* and FIG. 8*e* illustrate a bipolar circuit and related element conductivity state timing.
Figure 8E:
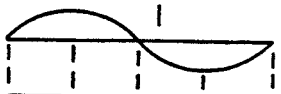

Referring now to FIG. 8*d*, there is illustrated one example of a bipolar circuit in accordance with the invention. In this circuit, energy transfer is controlled in each direction. By effectively providing two FIG. 8*a* type circuits coupled to the loop inductance L, two direction control switches, DCA and DCB, and two rate control switches, RCA and RCB, are required. The switching control cycle is indicated in FIG. 8*e*, wherein "O" indicates a device is in a non-conductive state, "C" indicates a conductive state, and "M" indicates modulated opening and closing cycles responsive to a control signal. In theory, a bipolar circuit could provide an efficiency improvement of twice that of a unipolar circuit such as shown in FIG. 8*a*, assuming the use of the same switching devices. The efficiency improvement does, however, require greater circuit complexity, as shown. As represented in FIG. 8*e*, bipolar operation involves four modes, which may be identified by increasing or decreasing positive current and increasing or decreasing negative current. A bipolar circuit embodiment will be further described with reference to FIGS. 19, 20*a*, 20*b*, 20*c* and 20*d* and 21.

Figure 9:
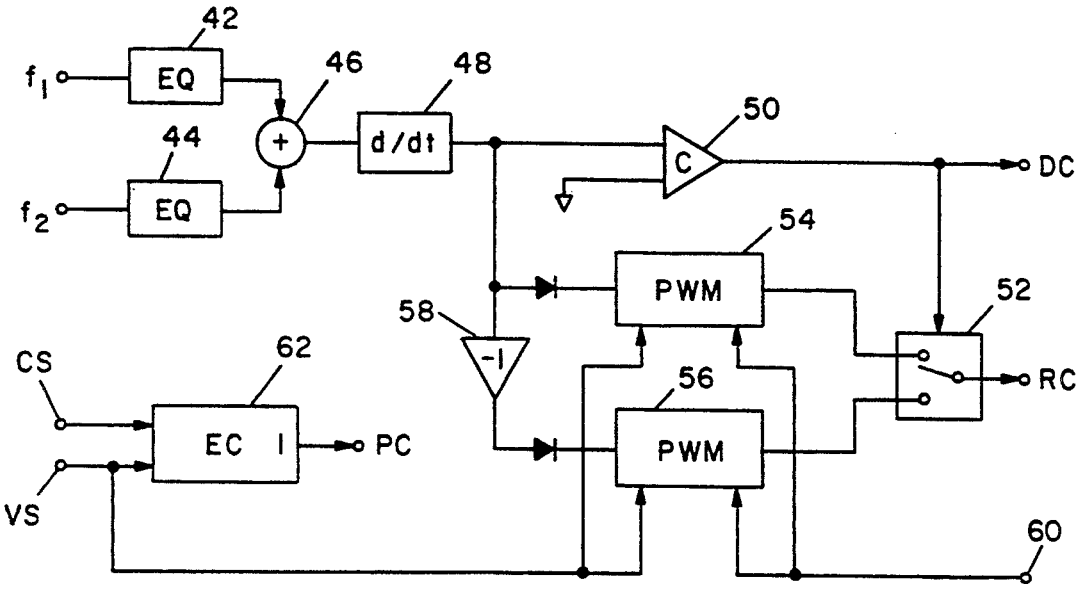
FIG. 9 shows a form of a control circuit for use in the FIG. 5*a* system in accordance with the invention.

One form of control circuit 30 of FIG. 5*a*. for use in a synthesizer radiating system in accordance with the invention is illustrated in FIG. 9. Input signals, which define the desired output waveform, may be coupled to amplitude equalizers 42 and 44. The signals from equalizers 42 and 44 are summed at 46 and the resulting signals are differentiated in differentiator 48 in order to determine the desired rate of change. Prior to differentiation, amplitude equalizers are used in order to compensate for nonlinear frequency response of the load (e.g., the radiation resistance of a loop antenna varies as the fourth power of frequency). A comparator 50 is used to sense whether the rate is positive or negative (current increasing or decreasing through the loop). The comparator 50 output is used to control the direction control switch. Separate pulse width modulators 54 and 56, coupled via switch 52, are used to determine the rate control switch duty cycle depending on whether C to L transfer is desired (positive di/dt) or whether L to C transfer is desired (negative di/dt). For positive di/dt, the switch closure duty cycle as determined by modulator 54 is proportional to the magnitude of di/dt, whereas, for negative di/dt, the switch open duty cycle as determined by modulator 56 is proportional to the magnitude of −di/dt. In both direction modes, the capacitor voltage as coupled via terminal VS is used as a control variable and the di/dt signals of appropriate polarity are provided by amplifier 58 and two diode rectifiers as shown. The direction control from comparator 50 is used to select the appropriate modulator output. In the FIG. 9 controller circuit it will be seen that DC, RC and PC control signal outputs are respectively provided for control of the direction control, rate control and power control switching devices as represented in FIG. 8*a*.

It should be noted that this function, as described, could also be accomplished by the use of an appropriately arranged combination of a full-wave rectifier, a single pulse width modulator, and a selector switch which chooses either the inverted or non-inverted modulator output. In operation of the FIG. 9 circuit, clock pulse signals for the control of the operation of pulse width modulators 54 and 56 are provided via terminal 60. An energy computation circuit 62 is arranged, in response to inputs at terminals CS and VS representing current sensing and voltage sensing signals responsive to the current through load L and the voltage across capacitor C, to provide a control signal at terminal PC which is usable to control the intake of energy in order to maintain energy within the circuit at desired levels. Thus, with reference to FIG. 5*a*, the PC power control signal responsive to radiating element current changes and storage capacitor voltage changes controls a power coupling device, shown as switch 32 in FIG. 5*a*, to permit DC power provided at terminal 26 to be coupled into the system to replenish energy dissipated in operation.

Figure 10A:
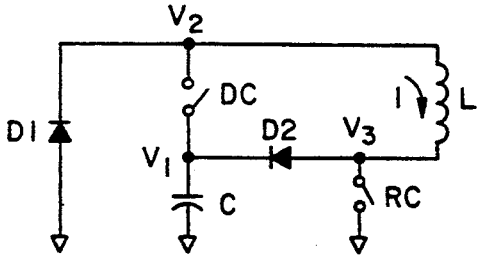
FIG. 10*a* and FIG. 10*b* illustrate waveforms in operation of a basic synthesizer radiating system using the invention.
Figure 10B:
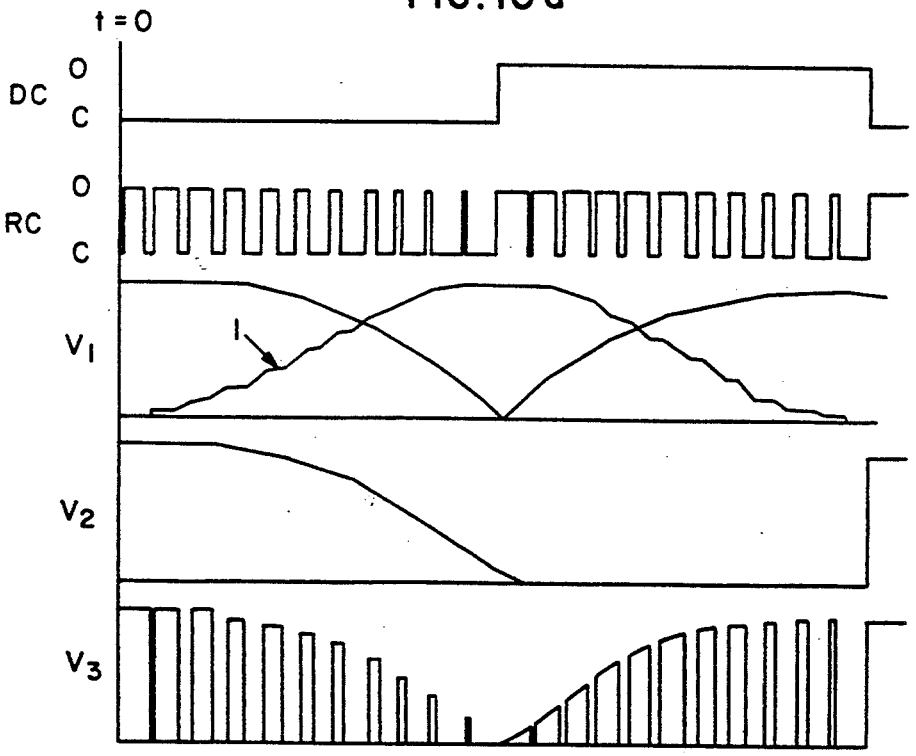

The waveforms of a synthesizer radiating system using the invention are shown in FIG. 10*b*. In the given example, the basic switching frequency has been selected 24 times greater than the desired output frequency. This results in only a small amount of distortion in the loop current waveform I, indicated in FIG. 10*a*. A radiating system operating at 2 MHz would require a 48 MHz switching rate in order to reproduce these results. In FIG. 10*b*, the waveforms $V_1$, $V_2$ and $V_3$ represent voltages at the points so labeled in the simplified circuit diagram shown at the top of FIG. 10 and the DC and RC waveforms indicate the open and close cycles of the respective direction control and rate control switching devices in the circuit diagram. The capacitance value of the storage capacitor C and the operating voltage are selected based on the desired radiated power and frequency. The desired current is found from:

$$P_{OUT} = 1/2\, I^2_{PEAK}\, R_R \tag{15}$$

$$R_R = 31000\, N^2 \left(\frac{A}{\lambda^2}\right)^2 \tag{16}$$

where $R_R$ equals the loop radiation resistance, N is the number of turns in the loop, A is the loop area and λ is wavelength. For a sinusoidal current waveform:

$$V_{PEAK} = 1.38L\, \omega I_{PEAK} \tag{17}$$

$$C = 1/(1.92L\, \omega^2) \tag{18}$$

Equations (17) and (18) apply to the circuit shown in FIG. 10*a*, which produces a unipolar current, i.e., positive current always passes through the inductor. As a point of comparison, a class B push-pull circuit is bipolar, i.e., current flows bi-directionally and symmetrically about zero.

It should be noted that, when used with small antennas, the greatest di/dt will be required at the lowest operating frequency. That occurs because the radiation resistance is proportional to the fourth power of frequency. For an electric type antenna (i.e., a dipole or whip), the radiation resistance varies as the square of frequency. Therefore, a radiated power variation that is allowed to increase with the third power of frequency for loop antennas, or directly with frequency for electric field type antennas, still enables the calculation for the maximum di/dt to be made at the lowest operating frequency.

Figure 11A:
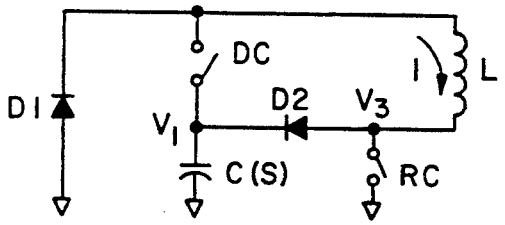
FIG. 11*a* and FIG. 11*b* illustrate waveforms for a modified synthesizer radiating system using the invention.
Figure 11B:
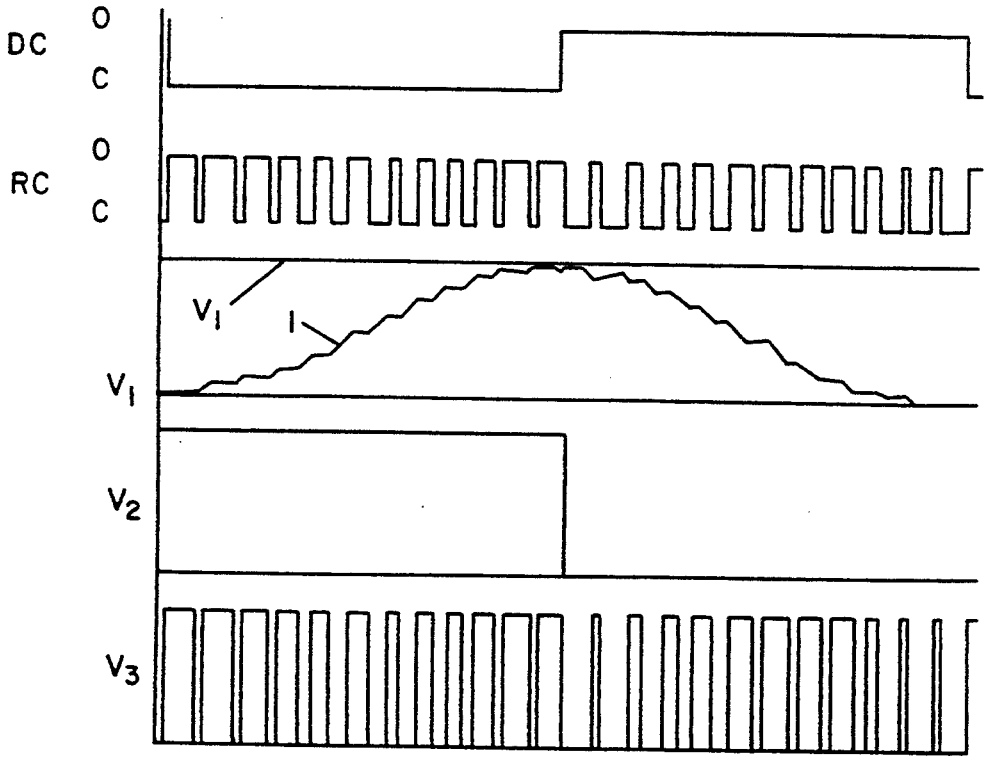

A synthesizer radiating system providing simplified control, but at the expense of a small loss in efficiency, is represented in FIG. 11*a*, along with related waveforms in FIG. 11*b*. The principal difference from the previous circuit is that this one uses a very large storage capacitor C(S). The circuit functions in the same manner, i.e., energy is transferred back and forth between L and C. However, in this case, since the storage reactance is much larger than the antenna reactance, the total circuit energy is much larger than the peak stored inductor energy. During initial power-up, a large amount of energy is added to the storage capacitor in order to charge it up to the desired voltage. The capacitor energy is only perturbed by a small amount as energy is added to or subtracted from the inductor. As a result, the capacitor voltage remains relatively constant during circuit operation. That enables two control circuit simplifications. First, power supply control only requires the maintenance of a fixed capacitor voltage, thereby permitting use of standard external regulator circuits to provide a fixed voltage $V_1$. Energy computation circuit 62 of FIG. 9 may thus be omitted. Second, the rate control dependence on capacitor voltage is eliminated. Two equations govern operation:

$$V_{CAP} = L\, \omega\, I_{PEAK} \tag{19}$$

$$\text{DutyCycle} = \frac{di}{dt}\left(\frac{L}{V}\right) \tag{20}$$

where V is constant. Positive and negative rate controls are still inverse control functions as previously described.

Embodiments of the simplified circuit of FIG. 11*a* may operate with somewhat lower efficiency for two potential reasons. First, the loss associated with the larger storage capacitor may be greater, although this loss may be insignificant compared to other losses. Second, the efficiency loss that results from parasitic switch capacitance will be marginally higher. That loss is proportional to the square of voltage across the switch at the time when the switch cycles from open to closure. The average voltage across the switch over one period of output variation is higher in the case of a simplified circuit utilizing a large storage capacitor C(S).

Figure 12A:
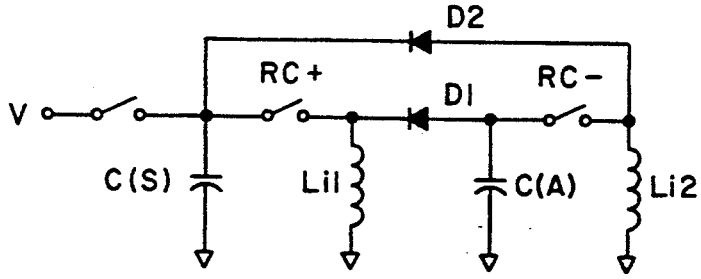
FIG. 12*a* illustrates application of the invention to a unipolar circuit with energy transfer between elements of like reactance (C to C).
Figure 12B:
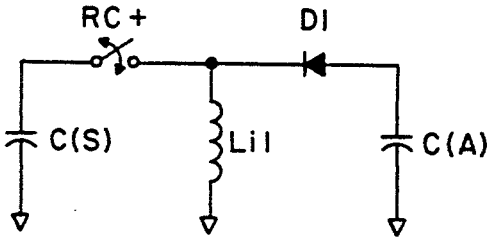
FIG. 12*b* and FIG. 12*c* show the effective circuit of the circuit elements of FIG. 12*a* when operating in the positive transfer direction mode and the effective circuit for the negative transfer direction mode, respectively.
Figure 12C:
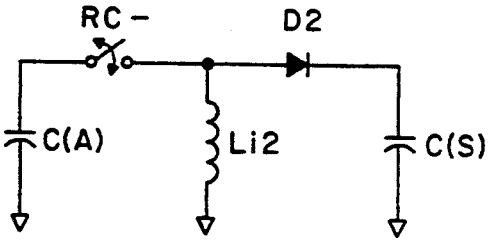

Another embodiment of the invention using energy transfer between a capacitive antenna reactance and a capacitive storage element (C to C operation) is illustrated in FIG. 12*a*. This circuit does not employ separate rate and direction control switches. Two rate control switches are incorporated, with the direction of transfer of energy determined by which of the two switches is activated. For example, a positive transfer of energy from the storage capacitor C(S) via interim inductor Li1 to the antenna capacitance C(A) is accomplished by cyclical operation of the positive rate control switch RC+, while the negative rate control switch RC− remains continuously open. The effective circuit when operating in the positive transfer direction mode and the effective circuit for the negative transfer direction mode are shown in FIGS. 12*b* and 12*c*, respectively, which show the circuit elements of FIG. 12*a* which are operative for each mode. In each direction mode, transfer is accomplished, via the respective one of the interim inductors Li1 and Li2, by a series of switch closure and opening cycles as previously described with reference to FIG. 6*c*.

Figure 13:
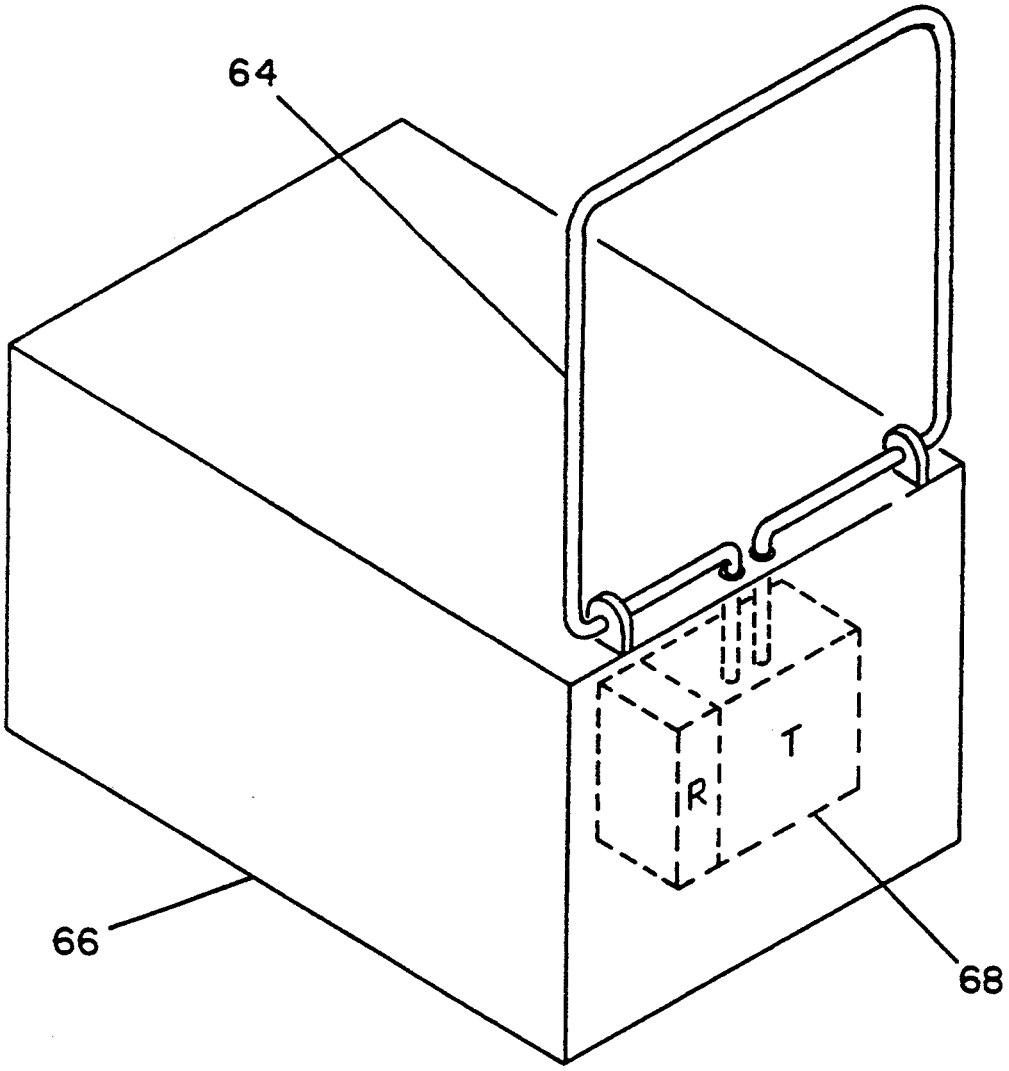
FIG. 13 illustrates an installation of a synthesizer radiating system in accordance with the invention on a simplified representation of a motor vehicle.

A typical application as currently contemplated will be described with reference to FIG. 13, which shows a representation of a synthesizer radiating system, in accordance with the invention. As illustrated in FIG. 13, a high-frequency loop antenna 64, which is small in relation to the wavelength in the intended operating frequency band, is mounted at the rear of a vehicle represented in simplified outline as the box 66. The components of the radiating system other than radiating element 64 are mounted within the vehicle, as represented by the coupling of the loop 64 to the dashed box 68. In this configuration, the synthesizer radiating system would be arranged to receive low power information signals from a suitable source providing an input waveform representing signals to be transmitted, and the synthesizer radiating system would provide the desired radiated signal.

As illustrated in FIG. 13, the system includes a loop radiating element 64 which consists of a single turn of a conductive member approximately 5 feet, or 1.5 meters, on a side, which is designed to operate over a frequency band of 4 to 14 MHz producing approximately 1 watt of radiated power from the antenna. Box 66 may represent a small jeep-type vehicle or a larger truck or other vehicle. The type of vehicle is not important, however, it is significant that the application shown illustrates that the invention makes it possible to mount an antenna system capable of effective operation with signals of wavelengths of the order of 200 feet, or 60 meters, on a small vehicle. Thus, in such an application, effective radiated signal strength can be achieved while limiting overall power requirements as a result of the reduced energy dissipation achieved with the present invention, as compared to prior systems. Based upon computed results, estimates were made of performance of the FIG. 13 type system as compared to a narrow band tuned system, providing high efficiency with a very narrow bandwidth, and a wider band, high power dissipation system with a Class B push-pull amplifier, representing the alternative approaches referred to above. Such comparative analysis is summarized as follows, with radiated power and DC input power in watts:

| System Type | Radiated Power | DC Power | Bandwidth |
|---|---|---|---|
| Narrow band tuned | 1 W | 50 W | 20 KHz at 4 MHz |
| FIG. 5a/FIG. 13 | 1 W | 300 W | 4–14 MHz |

-continued

| System Type | Radiated Power | DC Power | Bandwidth |
|---|---|---|---|
| Class B push-pull | 1 W | 10,000 W | 4–14 MHz |

The above estimated figures are based upon use of a variable tuner in the narrowband system, with the Q of the tuner estimated at 200. The Q of the antenna (FIG. 13 type, commonly utilized in each example) at 4 MHz was calculated at 10,000.

As indicated by these comparative figures, in this example the present invention provides full band operation with only 8 dB poorer energy efficiency than the very narrowband tuned system. At the same time, the present invention provides energy efficiency 15 dB better than the conventional class B approach, as indicated in this analysis. It will be appreciated, that by extension of the 300 W to 10,000 W differential in power requirements, as shown above for comparable radiated power and operating bandwidth between systems using the invention and a conventional system in this example, radiating systems with effective bandwidth/radiated power characteristics can be made much more transportable. Thus, in addition to the practicality of using the invention in mobile applications in a vehicle-mounted configuration, FIG. 13 is illustrative of benefits of the invention in providing radiating systems with high efficiency/low dissipation characteristics enabling the provision of manually transportable and other convenient configurations in appropriate applications.

It should be noted that while a primary focus of the invention is on high efficiency/broadband radiating systems operable with a wide range of input waveforms with the operational benefits of signal synthesis as described, in many applications it may be desirable to receive as well as transmit data or voice messages. Once having the benefit of an understanding of the invention, known techniques can be employed to use the radiating antenna, such as loop 64 in FIG. 13, for the reception of signals. This is indicated in FIG. 13 by the portion R of box 68, which represents associated receiver circuitry. Thus, in a typical application, an input signal such as a voice message may be input via a microphone device and coupled to a FIG. 5*a* type synthesizer radiating system in accordance with the invention, via a modulator arranged to modulate a carrier (at 4 MHz, for example) with the voice message and supply such modulated carrier to an input waveform terminal, such as terminal 28 in FIG. 5*a*. Then, assuming the radiating system is arranged for operation in a standard one-half duplex format, a transmit/receive (T/R) device, such as a diplexer, may be introduced in known manner to permit the receiver portion R of the FIG. 13 system to receive incoming communication signals coupled by antenna 64 during periods in which the radiating system is not using the antenna for signal transmission purposes. Alternatively, the receiving portion R of the FIG. 13 system may include its own separate receive antenna. The receiving function is less critical in implementation, and a simple independent antenna of the order of one foot or one-third meter in length can be arranged to support the signal reception function without any requirement for shared use of loop antenna 64. It should also be noted that the inherent broadband characteristic enables multiple simultaneous voice or data inputs that can be modulated onto carriers, with different center frequencies arbitrarily chosen, for radiation as a composite signal serving multiple uses.

HIGH FREQUENCY IMPLEMENTATION

Five principal loss mechanisms are relevant to high frequency applications: switch parasitic capacitance, switch ON resistance, diode voltage drop, inductor losses and storage capacitor losses. All practical switching devices have a parasitic capacitance which can result in significant power dissipation, particularly at higher switching frequencies, depending upon the voltage across the switch terminals when the switch is closed. For example, a calculated value for parasitic capacitance loss in rate control switch RC of FIG. 11*a* is 2.5 watts, assuming a switch capacitance of 10 picofarads, an operating voltage of 100 volts, and a switching rate of 50 MHz. Dissipation in the direction control switch DC would be significantly lower because it is cycled once each output period rather than at the basic switching frequency. Switch ON resistance produces dissipation wherever a switch closes and conducts current. Diode voltage drop which is typically in the range of one-half to one volt produces power dissipation whenever a diode is in forward conduction. Inductor loss results from ohmic resistance associated with the size, material and geometry of the conductor forming a loop antenna, for example. This resistance is usually much larger than the radiation resistance of the radiating element and is different for the DC and high-frequency components of a current. Storage capacitor losses include DC leakage current and equivalent series resistance at high frequencies.

Figure 14A:
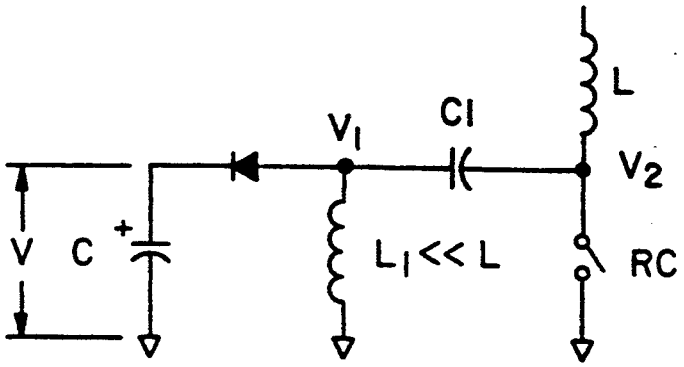
FIG. 14*a* and FIG. 14*b* illustrate an embodiment of the invention lacking a direction control switch, and including an inductance arrangement for reduced switch capacitance power dissipation.
Figure 14B:
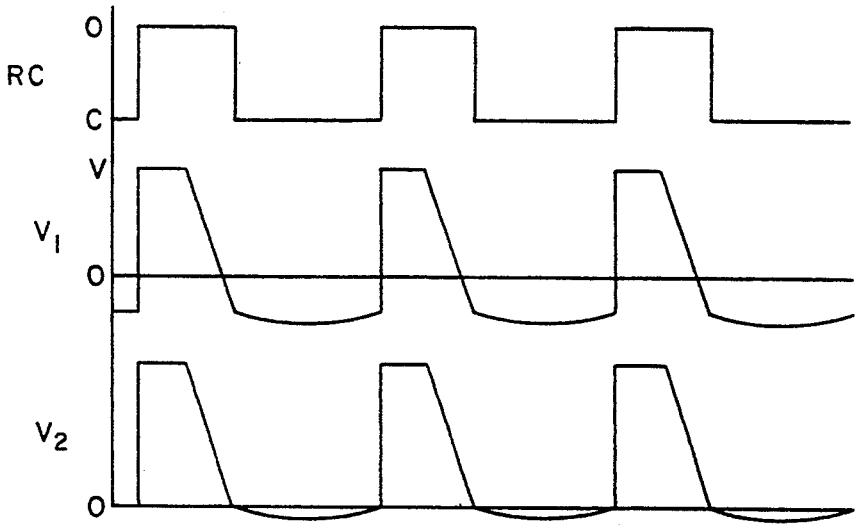

In addressing performance issues, two primary considerations are parameter limitations of practical devices and spurious radiation at the switching frequency of rate control switching device RC. For example, MOSFET devices are currently considered to represent a preferred choice in the effort to optimize output capacitance, ON resistance and breakdown voltage in a high-frequency switching device. Also, where high-voltage operation is required to realize desired radiated power levels, it may be necessary to use multiple switching devices in series connection because of voltage limitations of most currently available high-frequency devices. While series connection has the benefit of lowered composite switch capacitance, ON resistance increases by a similar factor. In accordance with the invention, alternative circuit configurations may be used to address switch capacitance dissipation. For example, FIG. 14*a* shows a simplified synthesizer radiating system circuit wherein a small inductor $L_1$ is included to reduce such dissipation. Capacitor $C_1$ provides a DC block. As shown in FIG. 14*b*, the transient response of the circuit, after the switch changes to an open state, results in the switch voltage cycling back to zero. Thus, as shown in the $V_2$ waveform, the RC switching device can then be closed without dissipating energy, since there is no voltage across it. In addition, it has been found that power dissipation can be optimized by the adjustment of the effective antenna impedance. The optimum impedance in this respect is equal to the square root of the resultant of one-half RON divided by the product of C times F, where RON is the switch ON resistance, C is its capacitance and F is the switching frequency. The antenna impedance can be adjusted for this purpose by the addition of a wideband transmission line type transformer of a known type, indicated as transformer 21 in FIG. 5*d*, for example. Alternatively, optimum impedance matching can be achieved by varying the circuit-determined optimum impedance by use of parallel or series connected switching devices so as to cause the optimum impedance calculated as above to closely approximate the actual antenna impedance.

In another configuration, a push-pull arrangement of rate control switching devices can be utilized without inclusion of a direction control switch. In such an arrangement, current is simultaneously added to and subtracted from the inductive load at all times. In the equilibrium state, equal amounts of current flow in both directions and the net current flow is zero. The desired current is produced by unbalancing the circuit. Whereas the FIG. 14 circuit as shown operates for transfer of energy in one direction, it can be applied to both sides of the pushpull switch configuration. Thus, FIG. 14*a* shows a basic embodiment wherein switching means 24 of FIG. 5*a* includes a rate control switching device RC, but no direction control switching device. Similarly, the specification of diodes involves optimization of the choice of current handling, forward voltage drop and reverse recovery time parameters. For example, Schottky barrier diodes feature low voltage drop and fast switching time. Considerations of current flow resulting from short term reverse direction diode conduction at high switching rates can be compensated for by appropriate adjustment of control signals provided by the controller portion of the synthesizer radiating system.

With respect to spurious radiation at the switching frequency, as can be seen from the loop current waveform I in FIGS. 10 and 11, the load current is relatively smooth representing low level spurious radiation at the switching frequency. However, increased radiation resistance at such frequencies tends to increase the radiation. To reduce such radiation a low pass filter, such as shown at 19 in FIG. 5*c*, or band reject filter can be inserted in series with the loop inductance, or the geometry of the antenna element may be adjusted to make such element appear anti-resonant or as a very high impedance in the vicinity of the switching frequency. Alternatively, the switching frequency may be randomized in order to spread spurious radiation over a band of frequencies. This approach uses the fact that power spectral density, rather than total spurious energy, is of greater concern regarding interference and randomization can lower spectral density significantly.

EXEMPLARY EMBODIMENTS

A particular embodiment of a synthesizer radiating system in accordance with the invention will now be described in greater detail with reference to FIGS. 15, 16 and 17. These figures show respectively a representation of a loop inductor radiating element, a schematic diagram of the synthesizer radiating system exclusive of the controller (see FIG. 5*a* for a simplified system diagram), and a schematic diagram of the controller portion of the system. This embodiment was configured to demonstrate operation of the invention independently of high frequency limitations of basic components, and an operating frequency of 20 KHz was, therefore, selected. The associated switching frequency was specified as approximately 200 KHz. The synthesizer radiating system as assembled and tested was basically the system as illustrated in FIG. 11*a* and described with reference thereto. For purposes of relative comparison and quantification of performance results, the same radiating element (see FIG. 15) was operated with a matched class B push-pull linear amplifier in order to provide data as to power dissipation and efficiency for a prior art type arrangement driving the same radiating element.

Figure 15:
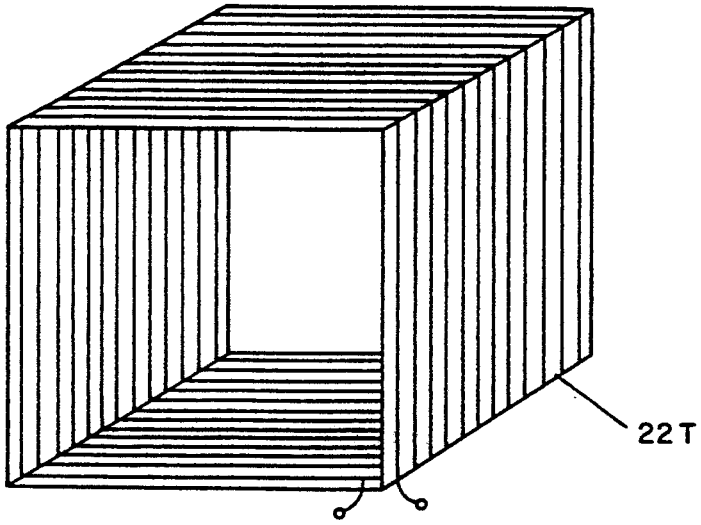
FIG. 15 shows an example of a small loop antenna for use with the invention.
Figure 16:
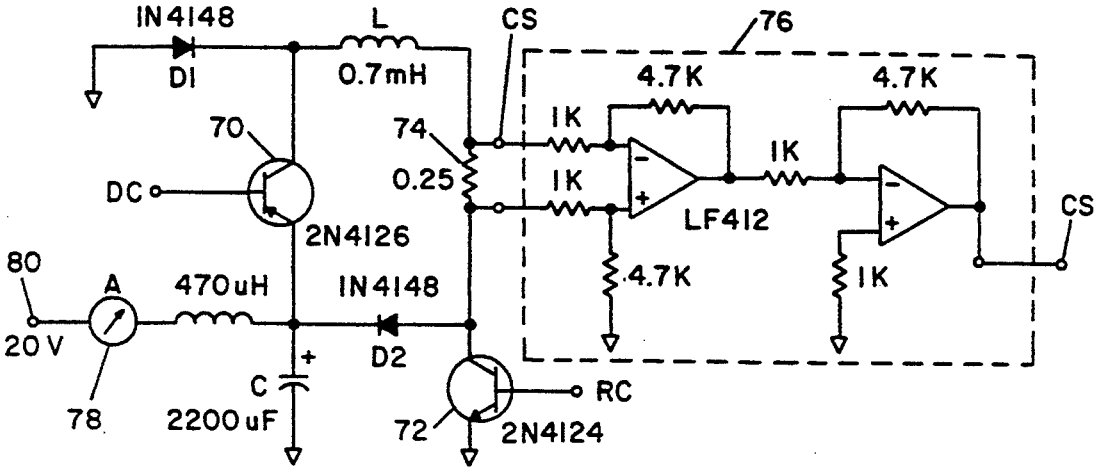
FIG. 16 is a schematic diagram of one form of a synthesizer radiating system in accordance with the invention, exclusive of controller 30 of FIG. 5*a*.

A sketch of the loop inductor radiating element is shown in FIG. 15. An inductance of 0.7 mH was measured, corresponding to a reactance of 87 ohms at 20 KHz. The DC resistance of the loop was measured at 0.65 ohms, while the Q at 20 KHz was estimated at approximately 100. 20 KHz is a transitional frequency where the skin depth approaches the wire diameter, enabling DC resistance to be used as an estimate of RF resistance. In this example the FIG. 15 loop inductor element comprised 22 turns, each 1.2 meters on a side, arranged in a configuration 0.9 meters deep.

At the 20 KHz operating frequency, it was not necessary to measure radiation efficiency in order to compare the performance of the system using the invention against the conventional class B approach. Relative efficiency was evaluated comparing the amount of power delivered by the DC power supply, based upon measured 20 KHz currents driven through the loop in each case. Controller power was ignored because controller power is not a function of radiated power and a circuit producing substantial radiated power will dissipate a negligible amount of controller power, compared to the total dissipation. The measurement was thus designed to provide an improvement factor applicable to the high power case, which is the preferred application, as currently contemplated. The class B push-pull amplifier followed a standard approach, using complementary emitter followers. The highest efficiency was obtained with the drive adjusted to produce an output voltage of 12 volts peak to peak, corresponding to a peak loop inductor current of 0.069 amps. The DC power provided by the power supply was measured at 0.33 watts. This measured dissipation was estimated to be 1 dB more than for a theoretical class B amplifier arrangement.

Schematics of the synthesizer radiating system as constructed are shown in FIGS. 16 and 17*a*, 17*b* and 17*c*. Small-signal bipolar junction transistors 70 and 72 are used in the FIG. 16 circuit as direction and rate control switches. A ¼ ohm resistor 74 is placed in series with the loop L. Loop current is measured by monitoring the voltage drop across the resistor 74 at terminals CS. Circuit 76 represents a simple circuit for monitoring current flow based on the voltage drop measured across resistor 74. Thus, circuit 76 is provided for test/monitoring purposes only and is not involved in operation of the circuit. Ammeter 78 is provided in this example for test/monitoring purposes to provide measurement of current flowing from a 20 volt supply terminal 80 in replenishment of power used in operation of the FIG. 16 circuit. It will be seen that the FIG. 16 circuit corresponds basically to the FIG. 11*a* circuit as previously described. The controller portion shown in FIGS. 17*a*, 17*b* and 17*c* was constructed using op-amps, a timer, and comparator integrated circuits.

Figure 17A:
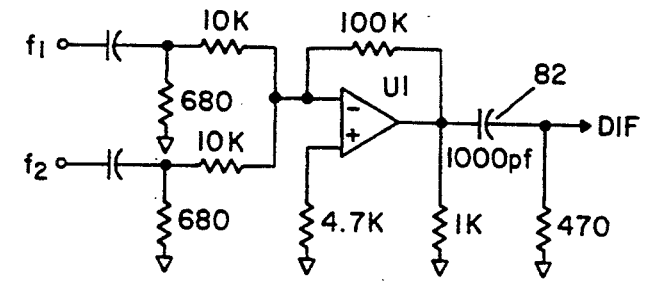
FIG. 17*a*, FIG. 17*b* and FIG. 17*c* are a schematic diagram of three sections of a controller circuit in accordance with the invention.

In FIG. 17*a* the desired input signal at terminals f1 and f2 is amplified and then differentiated using a small capacitor 82 (1000 pf). A voltage comparator 84 responsive to that differentiated signal is used to sense whether the output of the differentiator circuit is positive or negative. Its output is used to drive the direction control switch transistor 70 of FIG. 16. The positive and negative portions of the differentiator output are amplified and rectified by amplifiers 86 and 88 and related diodes (See FIG. 17*b*). The resulting output signals are fed to the pulse width modulators which are formed by comparators 90 and 92 operating with a sawtooth signal input from transistor 96 FIG. 17*d*. The timer IC 94 is arranged with transistor 96 to generate a sawtooth waveform at approximately 150 KHz. The sawtooth voltage varies at a rate much faster than the differentiated signal. The pulse width modulators 90 and 92 function by comparing the differentiated signal voltages to the sawtooth voltage. The outputs of the modulators 90 and 92 will switch as the sawtooth passes above and below the instantaneous signal voltage. The output duty cycles of modulators 90 and 92 depend on the magnitude of the differentiated signal voltages. Therefore, the duty cycle varies as the signal passes through its voltage range. The appropriate comparator inputs are selected by action of diode 98 in response to polarity control signals, coupled from comparator 84 to terminal 100, in order to obtain the correct duty cycle variation in the two direction modes. A high speed drive, utilizing drivers 102 and 104 and associated diodes as shown, is provided to supply the desired control signal to the rate control switch shown as transistor 72 of FIG. 16. As indicated in FIG. 16 the storage capacitor voltage for operation of this system was 20 volts.

Figure 17B:
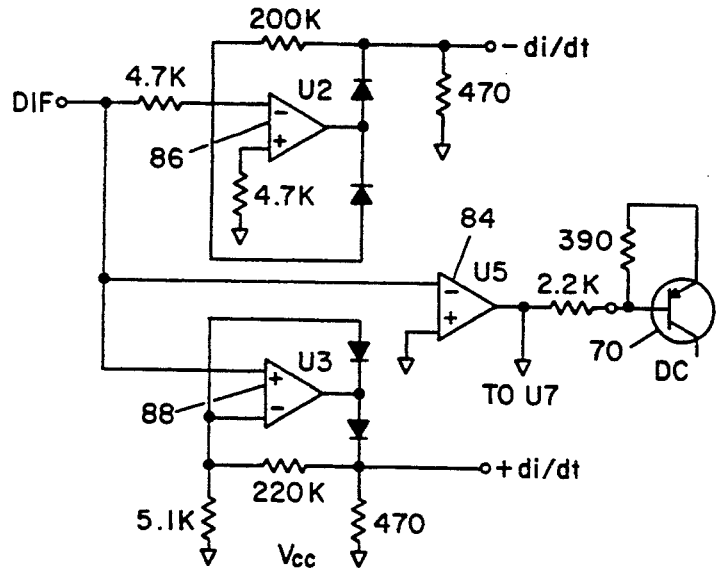
Figure 17C:
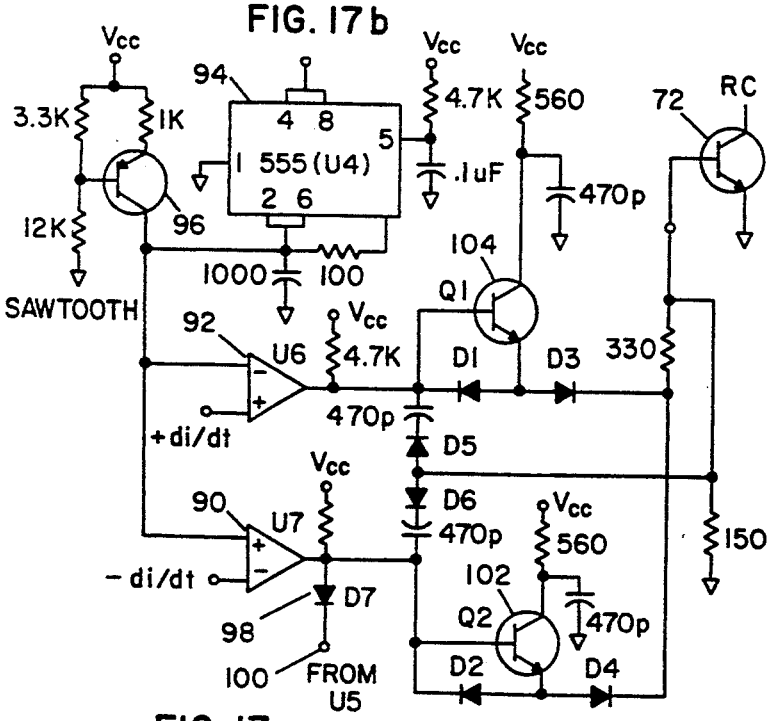
Figure 17D:
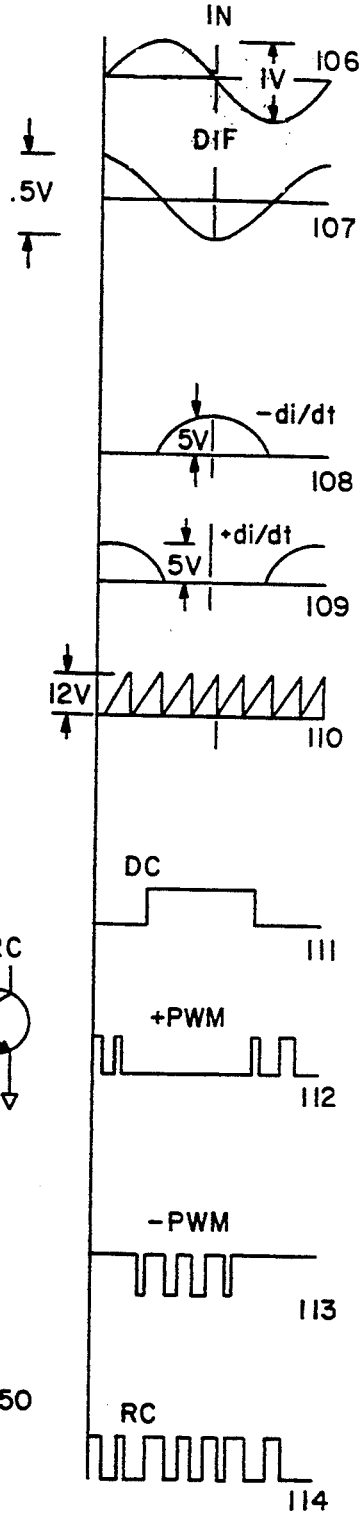
FIG. 17*d* shows related operating waveforms.

As shown, FIG. 17*d* includes representations of waveforms related to operation of the system of FIGS. 16 and 17*a*, 17*b* and 17*c*. Waveform 106 illustrates an input waveform at terminals f1 and f2, with the differentiated output from differentiator capacitor 82 shown at 107. Curves 108 and 109 respectively illustrate the amplified and rectified differentiated outputs produced by the circuits of amplifiers 86 and 88. Waveform 110 shows the sawtooth signal provided to pulse width modulators 90 and 92. Squarewave 111 represents the direction switching control signal provided to control the transistor 70. Waveforms 112 and 113 represent the pulse width modulated signals respectively provided as inputs to the high speed driver transistors 104 and 102 and waveform 114 represents the resulting rate switching control signal provided to control the transistor 72. It will be seen that the switching control signals 111 and 114 developed in the FIGS. 17*a*, 17*b* and 17*c* controller circuit correspond to the DC and RC waveforms shown in FIG. 11*a*. Thus, with reference back to the basic system block diagram of FIG. 5*a*, it will be appreciated that the circuit of FIGS. 17*a*, 17*b* and 17*c* represents an example of controller 30 and FIG. 16 encompasses units 20, 22 and 24 of FIG. 5*a*, with a test/monitor function provided by units 76 and 78.

In operation, the synthesizer radiating system embodiment of FIGS. 15, 16 and 17*a*, 17*b* and 17*c* exhibited a low distortion sinusoidal loop current waveform. A peak loop current of 0.12 amps. at 20 KHz was measured. The storage capacitor power supply delivered 0.3 watts to the circuit. An improvement factor of 3.3:1 over the class B amplifier was computed as described above. The resulting 5.2 dB improvement established successful implementation and operation of the invention.

Relevant loss components are listed below. Computed values of these loss components, the nature of which was discussed above, were determined in view of the actual operational results as follows:

| | |
|---|---|
| Switch ON resistance loss = | 0.09 Watt |
| Diode dissipation = | 0.12 Watt |

-continued

| | |
|---|---|
| Loop Inductor dissipation = | 0.03 Watt |
| Storage Capacitor dissipation = | 0 |
| Total | 0.24 Watt |

The ON resistance of a bipolar junction transistor device varies with current and can be computed for a specific current, given the saturation voltage of the device. An average resistance of 6 ohms was used in the calculation. The diode drop was measured at an average of 1 volt. The computed loss is 1 dB less than the measured value. The primary loss mechanisms as identified are switch resistance and diode drop. The switch resistance can be lowered by using a MOSFET switch which would typically exhibit 1 ohm or less of ON resistance. In addition, devices with a voltage breakdown of about 100 volts are available. Such devices enable circuit operation at levels of 70–80 volts, where diode drop is a much lower percentage of the output voltage.

Figure 18A:
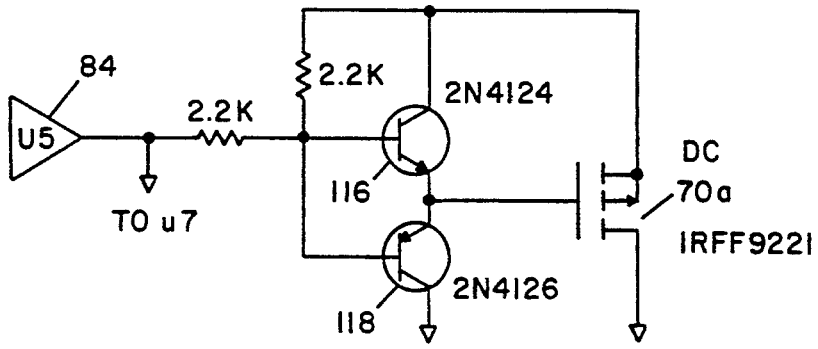
FIG. 18*a* and FIG. 18*b* show portions of the synthesizer of FIGS. 16 and 17 modified to utilize low loss switching devices.
Figure 18B:
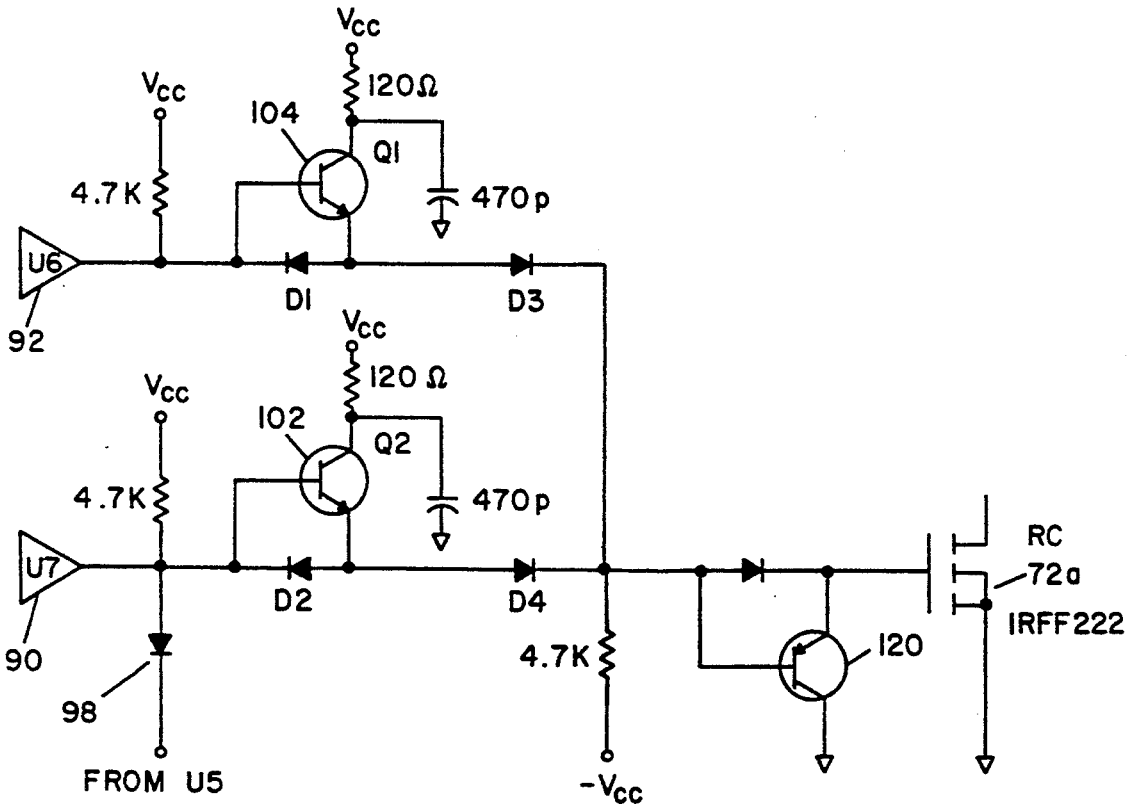

FIGS. 18*a* and 18*b* illustrates modifications to the circuit of FIGS. 16 and 17*a*, 17*b* and 17*c* in order to utilize MOSFET switching transistors (70*a* and 72*a*) and Schottky diodes (D1 and D2). The modified portions of FIGS. 17*b* and 17*c* are shown in FIGS. 18*a* and 18*b*. While the logic portions of the controller of FIGS. 16, 17*a*, 17*b* and 17*c* are unaffected by these component changes, it was necessary to modify the switch drive circuits, including addition of transistors 116, 118 and 120, as shown in FIGS. 18*a* and 18*b*.

The modified circuit of FIGS. 18*a* and 18*b*, when operated from a 30 volt supply required 365 mA or 1.1 watts in order to provide a 0.46 amp. peak output. This represents an improvement factor of 13.3:1, or 11.2 dB, over a class B amplifier as previously discussed. Relevant loss components were as follows:

| | |
|---|---|
| Switch ON resistance loss = | 0.37 Watt |
| Diode dissipation = | 0.23 Watt |
| Loop Inductor dissipation = | 0.28 Watt |
| Storage Capacitor dissipation = | 0.02 Watt |
| Total | 0.90 Watt |

These computed loss values assume the manufacturer's specified ON resistances of 1.5 and 1.2 ohms for the P-channel and N-channel MOSFETS, respectively, and 0.5 volt voltage drop for the Schottky diodes. The computed loss was within 1 dB of the measured value.

Figure 19:
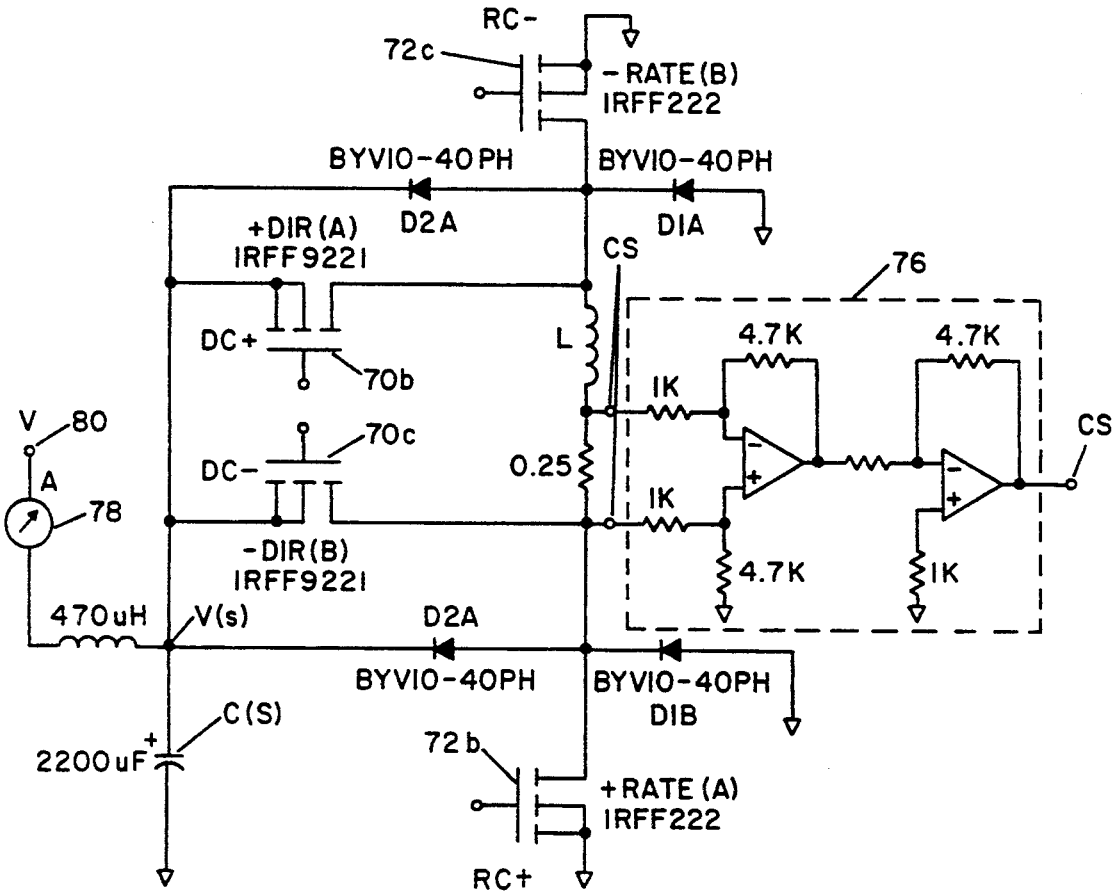
FIG. 19 and FIG. 20*a*, 20*b*, 20*c* and 20*d* illustrate portions of a bipolar synthesizer radiating system utilizing the invention
Figure 21A:
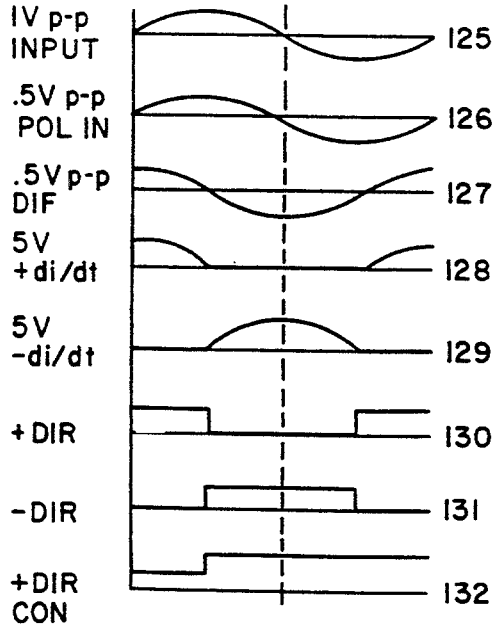
FIG. 21*a* and FIG. 21*b* show related waveforms.
Figure 21B:
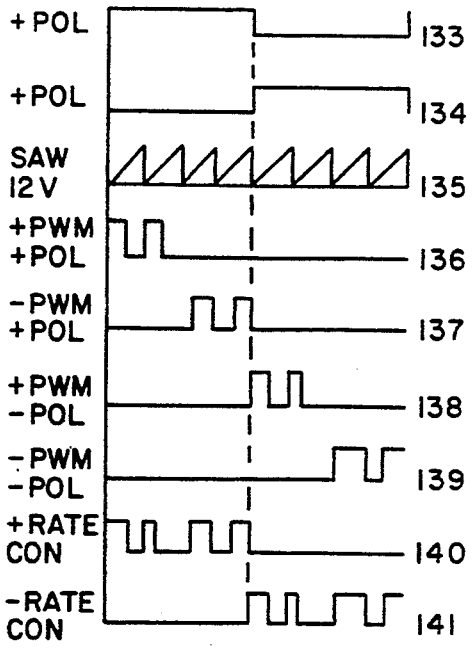
Figure 20A:
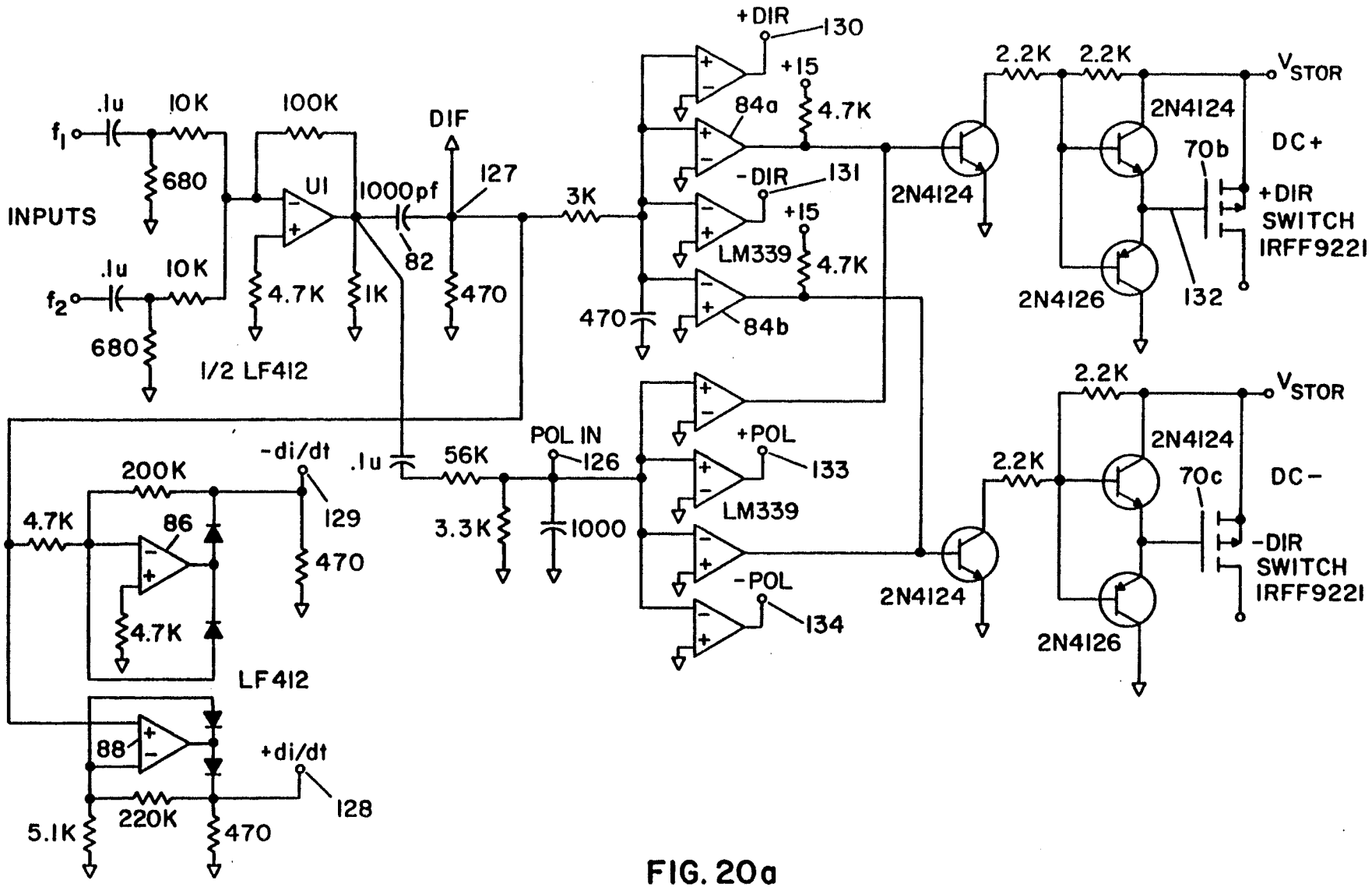
Figure 20B:
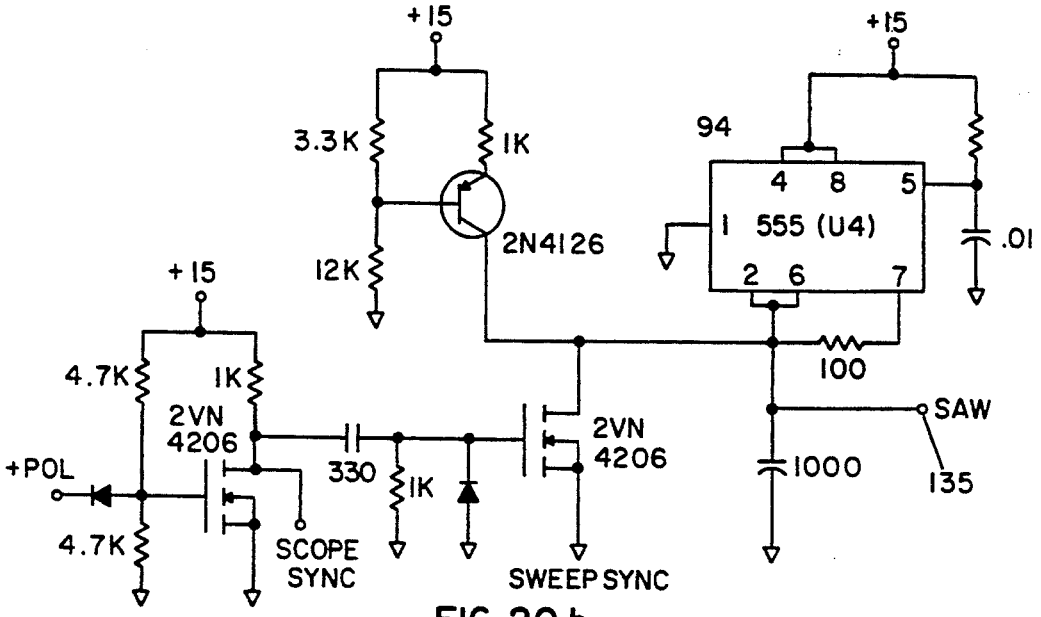
Figure 20C:
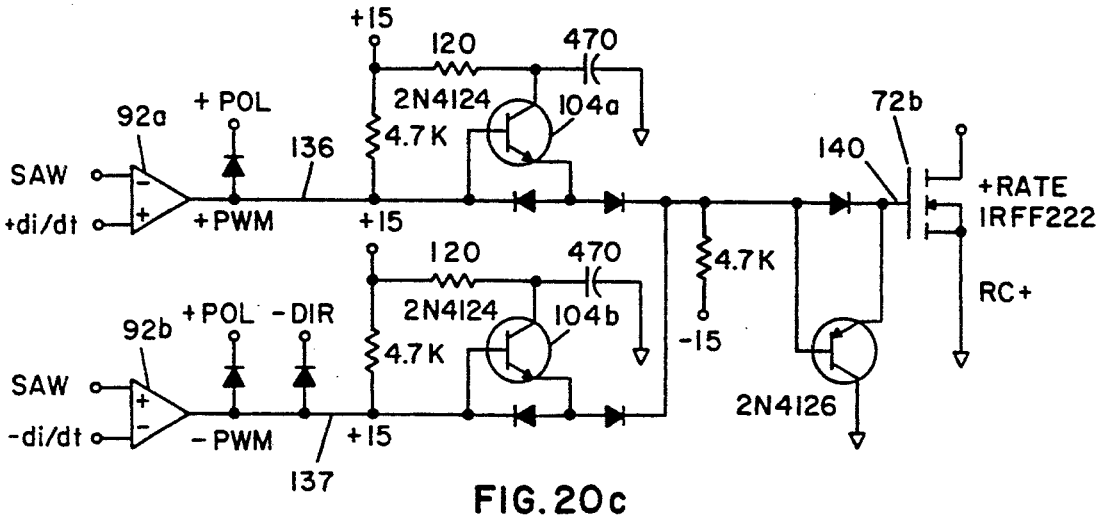
Figure 20D:
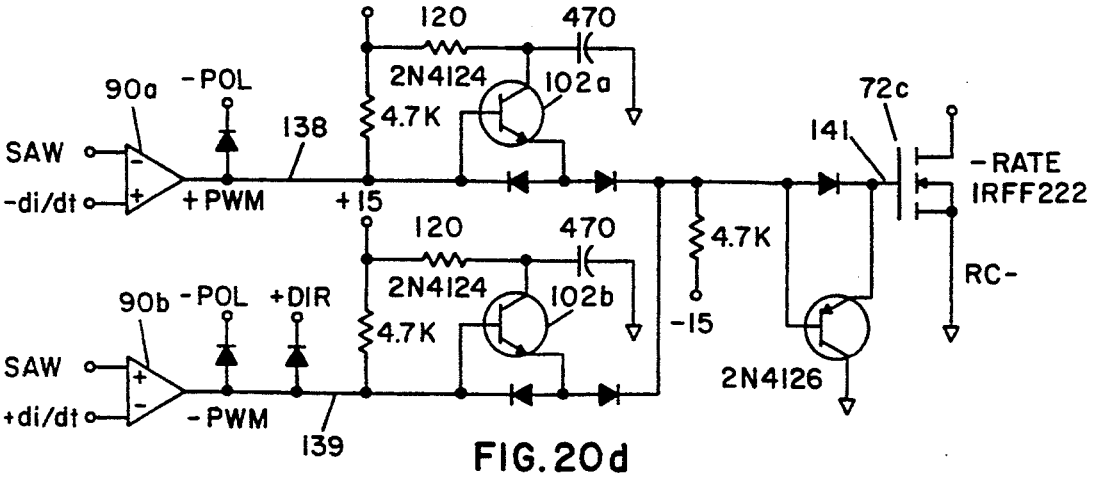

As a further exemplary embodiment of the invention, a bipolar circuit implementation is illustrated in FIGS. 19 and 20*a*, 20*b*, 20*c* and 20*d* (which correspond essentially to FIGS. 16 and 17*a*, 17*b* and 17*c* illustrating a unipolar arrangement). Thus, FIG. 19 shows the bipolar energy transfer loop and FIGS. 20*a*, 20*b*, 20*c* and 20*d* show the associated bipolar controller circuit. This bipolar implementation of a synthesizer radiating system feeding a loop antenna element employs the same basic components as used in the unipolar embodiment described above. However, duplicate circuit portions are utilized for the synthesis of positive and negative portions of the current waveform. During the time period in which the current waveform is positive or negative, respectively, it is necessary to cycle the direction control switch in order to enable increasing and decreasing current. Accordingly, the direction control switch cycles at a rate equal to twice that of the previously described unipolar embodiments. Pulse width modulation is used as a rate control algorithm in operation during each of the four periods over a complete cycle of the output waveform, in the same basic manner as in the unipolar modulator. Operation is more fully understood by reference to FIGS. 21*a* and 21*b*, which illustrates operating waveforms of the synthesizer radiating system of FIGS. 19 and 20*a*, 20*b*, 20*c* and 20*d* . The waveforms of FIGS. 21*a* and 21*b*, which correspond basically to the waveforms included in FIG. 17*d*, are associated with representative circuit points in FIGS. 20*a*, 20*b*, 20*c* and 20*d* as shown.

The bipolar embodiment of FIGS. 19 and 20*a*, 20*b*, 20*c* and 20*d*, when operated from a 15 volt supply, required 10.8 mA or 0.16 watts to provide a 0.235 amp. peak output. This represents an improvement factor of 24:1, or 13.8 dB, over a class B amplifier as previously discussed. Relevant loss components were as follows:

| | |
|---|---|
| Switch ON resistance = | 0.038 Watt |
| Diode dissipation = | 0.075 Watt |
| Loop Inductor dissipation = | 0.036 Watt |
| Storage Capacitor dissipation = | 0 |
| Total | 0.149 Watt |

The computation for these loss values used loss equations for a bipolar circuit. The theoretical dissipation values compared favorably with the measured results.

The purpose of this discussion of embodiments constructed and tested is not to provide specific operating parameters or to define the actual improvement factor achievable in different applications of the invention results achieved are effective, however, to clearly establish the significant improvements in operating bandwidth or operating efficiency, or both, available in applications of the present invention, as compared to various types of prior radiating systems.

While there have been described the currently preferred embodiments of the invention, those skilled in the art will recognize that other and further modifications and variations may be made without departing from the invention and it is intended to claim all such modifications as fall within the full scope of the invention.

What is claimed is:

1. A synthesizer radiating system, employing active control of energy transferred back and forth between an antenna reactance and a storage reactance, comprising:

antenna means, including a radiating element having a first reactive characteristic, for radiating signals;

energy storage means, including a storage element having a second reactive characteristic, for providing energy to and receiving energy from said radiating element;

switching means, coupled between said antenna means and said energy storage means, for controlling the rate of transfer of energy transferred back and forth between said storage element and said radiating element;

energy input means for coupling input energy from a source of electrical energy to said energy storage means;

signal input means for coupling input signals representative of a waveform to be radiated and;

controller means, coupled to said switching means and signal input means, for providing control signals to said switching means in response to said input signals for controlling the rate of transfer of said energy transferred back and forth between said storage element and said radiating element;

whereby, signals having a variety of waveforms may be radiated with reduced power dissipation as a result of conservation of energy by said transfer back and forth between said storage and radiating elements.

2. A synthesizer radiating system as in claim 1, wherein said radiating element included in said antenna means has a primarily inductive reactance and said storage element included in said energy storage means is a device having capacitive reactance.

3. A synthesizer radiating system as in claim 2, wherein said radiating element is a loop type antenna.

4. A synthesizer radiating system as in claim 1, wherein said radiating element included in said antenna means has a primarily capacitive reactance and said storage element included in said energy storage means is a device having inductive reactance.

5. A synthesizer radiating system as in claim 4, wherein said radiating element is a dipole type antenna.

6. A synthesizer radiating system as in claim 1, wherein said first and second reactive characteristics comprise a combination selected from the following listing, both capacitive and both inductive, and said system additionally includes an interim reactive element of the opposite reactance for providing intermediate storage of transferred energy during the transfer of said energy back and forth between said storage element and said radiating element.

7. A synthesizer radiating system as in claim 1, wherein the reactance value of said storage element is substantially larger than the reactance value of said radiating element, so that transfer of energy from said storage element to said radiating element does not substantially deplete the level of energy stored in said storage element.

8. A synthesizer radiating system as in claim 1, wherein said system is arranged to operate independently of inclusion of any circuit component having a primarily resistive impedance characteristic effective to dissipate such energy during any cycle of said energy transfer back and forth between said storage element and said radiating element.

9. A synthesizer radiating system as in claim 1, wherein said controller means includes a first pulse width modulator for controlling the switch closure duty cycle of a rate control switching device included in said switching means so that said switch closure duty cycle of said rate control switching device is proportional to the magnitude of a derivative of input signal current over time when energy is transferred from said energy storage element to said radiating element, and a second pulse width modulator for controlling the switch open duty cycle of said rate control switching device so that said switch open duty cycle of said rate control switching device is proportional to the magnitude of a derivative of input signal current over time when energy is transferred from said radiating element to said energy storage element.

10. A synthesizer radiating system as in claim 9, wherein said switching means additionally includes a direction control switching device for controlling the direction of transfer of energy transferred back and forth between said storage element and said radiating element, and said direction control switching device is caused to change condition in response to a direction control switching signal representative of reversals in the direction of change of an input signal waveform.

11. A synthesizer radiating system, employing active control of energy transferred back and forth between an antenna reactance and a storage reactance, comprising:

antenna means, including a radiating element having a first reactive characteristic, for radiating signals;

energy storage means, including a storage element having a second reactive characteristic, for providing energy to and receiving energy from said radiating element;

switching means, coupled between said antenna means and said energy storage means, for controlling the direction and rate of transfer of energy transferred back and forth between said storage element and said radiating element;

signal input means for coupling input signals representative of a waveform to be radiated;

controller means, coupled to said switching and signal input means, for providing control signals to said switching means in response to said input signals for controlling the direction of transfer of energy transfer between said storage element and said radiating element in response to changes in polarity of a signal representative of said input signals and for controlling the rate of transfer of said energy transferred back and forth in response to the magnitude of a derivative of an input signal current value over time, in order to synthesize said waveform to be radiated;

whereby, signals having a variety of waveforms may be radiated with reduced power dissipation as a result of said transfer of energy back and forth between said radiating and storage elements.

12. A synthesizer radiating system as in claim 11, wherein said radiating element included in said antenna means has a primarily inductive reactance and said storage element included in said energy storage means is a device having capacitive reactance.

13. A synthesizer radiating system as in claim 11, wherein said radiating element included in said antenna means has a primarily capacitive reactance and said storage element included in said energy storage means is a device having inductive reactance.

14. A synthesizer radiating system as in claim 11, additionally comprising:

energy input means for coupling input energy from a source of electrical energy; and energy input control means, coupled to said energy input means, for sensing the level of said energy transferred back and forth between said storage element and said radiating element and for controlling electrical energy input so as to control the level of said energy transferred back and forth.

15. A synthesizer radiating system, employing bipolar active control of energy transferred back and forth between an antenna reactance and a storage reactance, comprising:

antenna means, including a radiating element having a first reactive characteristic, for radiating signals;

energy storage means, including a storage element having a second reactive characteristic, for providing energy to and receiving energy from said radiating element;

first switching means, coupled between said energy storage means and said antenna means, for controlling at least one of rate and direction of transfer of energy transferred from said radiating element to said storage element;

second switching means, coupled between said antenna means and said energy storage means, for controlling at least one of rate and direction of transfer of energy transferred from said radiating element to said storage element;

signal input means for coupling input signals representative of a waveform to be radiated;

controller means, coupled to said first and second switching means and said signal input means, for providing control signals to said first switching means in response to said input signals for controlling at least one of rate and direction of transfer of said energy transferred from said storage element to said radiating element, and for providing control signals to said second switching means in response to said input signals for controlling at least one of rate and direction of transfer of said energy transferred from said radiating element to said storage element.

16. A synthesizer radiating system as in claim 15, wherein said radiating element included in said antenna means has a primarily inductive reactance and said storage element included in said energy storage means is a device having capacitive reactance.

17. A synthesizer radiating system as in claim 15, wherein said radiating element included in said antenna means has a primarily capacitive reactance and said storage element included in said energy storage means is a device having inductive reactance.

18. A synthesizer radiating system as in claim 15, wherein said first and second reactive characteristics comprise a combination selected from the following listing, both capacitive and both inductive, and said system additionally includes at least one interim reactive element of the opposite reactance for providing intermediate storage of transferred energy during the transfer of said energy back and forth between said storage element and said radiating element.

19. A synthesizer radiating system as in claim 15, wherein the reactance value of said storage element is substantially larger than the reactance value of said radiating element, so that transfer of energy from said storage element to said radiating element does not substantially deplete the level of energy stored in said storage element.

20. A synthesizer radiating system as in claim 15, wherein said controller means includes a first pulse width modulator for controlling the switch closure duty cycle of a rate control switching device included in said first switching means so that said switch closure duty cycle of said rate control switching device is proportional to the magnitude of a derivative of input signal current over time during a portion of the period in which energy is transferred from said energy storage element to said radiating element, and a second pulse width modulator for controlling the switch open duty cycle of an additional rate control switching device included in said second switching means so that said switch open duty cycle of said additional rate control switching device is proportional to the magnitude of a derivative of input signal current over time during a portion of the period in which energy is transferred from said radiating element to said energy storage element.

21. A synthesizer radiating system as in claim 20, wherein said first and second switching means are arranged for also controlling the direction of transfer of energy transferred back and forth between said storage element and said radiating element in response to reversals in the direction of change of an input signal waveform.

22. A synthesizer energy transfer system, employing active control of energy transferred back and forth between a high-Q load and a storage reactance, comprising:

a high-Q load having a first reactive characteristic;

energy storage means, including a storage element having a second reactive characteristic, for providing energy to and receiving energy from said high-Q load;

switching means, coupled between said high-Q load and said energy storage means, for controlling the rate of transfer of energy transferred back and forth between said storage element and said high-Q load;

signal input means for coupling input signals representative of control signals;

controller means, coupled to said switching and signal input means, for providing control signals to said switching means in response to said input signals for controlling the rate of transfer of said energy transferred back and forth between said storage element and said high-Q load.

23. A method for coupling signals to an antenna reactance, employing signal synthesis using energy transferred back and forth between said antenna reactance and a storage reactance, comprising the steps of:

(a) storing energy in said storage reactance;

(b) transferring a portion of said energy stored in step (a) to said antenna reactance via an actively controlled switching device;

(c) controlling the rate of transfer of energy in step (b) by controlling said switching device in response to an input signal in order to synthesize a signal to be radiated;

(d) transferring back to said storage reactance, via said switching device, a portion of said energy transferred to said antenna reactance in step (b);

(e) controlling the rate of transfer of energy in step (d) by controlling said switching device;

(f) repeating steps (b) through (e) as desired; and (g) storing additional energy in said storage device to provide replenishment of energy dissipated.

24. A method as in claim 23, wherein step (a) includes storing energy in a capacitive storage reactance, and step (b) includes transferring a portion of said stored energy to an inductive antenna reactance.

25. A method as in claim 23, wherein step (a) includes storing energy in an inductive storage reactance, and step (b) includes transferring a portion of said stored energy to a capacitive antenna reactance.

26. A method as in claim 23, wherein step (a) includes storing energy in a storage reactance of a first type, and step (b) includes transferring a portion of said stored energy to an antenna reactance also of said first type, said method including the additional step of providing intermediate storage of said transferred energy in an interim reactive element having a reactance of the opposite type from said first type.

27. A method as in claim 23, additionally including the step of:

controlling the initiation and duration of energy transfer in steps (b) and (d) in response to direction control signals representative of reversals in the direction of change of the waveform of said input signal.

28. A method as in claim 23, wherein step (c) comprises controlling the rate of transfer of energy in step (b) so that the switch closure duty cycle of said switching device is proportional to the magnitude of a derivative of input signal current over time, and step (e) comprises controlling the rate of transfer of energy in step (d) so that the switch open duty cycle of said switching device is proportional to the magnitude of a derivative of input signal current over time.

29. A method for bipolar coupling of signals to an antenna reactance, employing signal synthesis using energy transferred back and forth between said antenna reactance and a storage reactance, comprising the steps of:

(a) storing energy in said storage reactance;

(b) transferring a portion of said energy stored in step (a) to said antenna reactance via a first actively controlled switching device;

(c) controlling the rate of transfer of energy in step (b) by controlling said first switching device in response to an input signal in order to synthesize a signal to be radiated;

(d) transferring back to said storage reactance, via a second actively controlled switching device, a portion of said energy transferred to said antenna reactance in step (b);

(e) controlling the rate of transfer of energy in step (d) by controlling said second switching device;

(f) repeating steps (b) through (e) as desired; and (g) storing additional energy in said storage device to provide replenishment of energy dissipated.

30. A method as in claim 29, wherein step (a) includes storing energy in a capacitive storage reactance, and step (b) includes transferring a portion of said stored energy to an inductive antenna reactance.

31. A method as in claim 29, wherein step (a) includes storing energy in an inductive storage reactance, and step (b) includes transferring a portion of said stored energy to a capacitive antenna reactance.

32. A method as in claim 29, wherein step (a) includes storing energy in a storage reactance of a first type, and step (b) includes transferring a portion of said stored energy to an antenna reactance also of said first type, said method including the additional step of providing intermediate storage of said transferred energy in an interim reactive element having a reactance of the opposite type from said first type.

33. A method as in claim 29, additionally including the step of:

controlling the initiation and duration of energy transfer in steps (b) and (d) in response to direction control signals representative of reversals in the direction of change of the waveform of said input signal.

34. A method as in claim 29, wherein step (c) comprises controlling the rate of transfer of energy in step (b) so that the switch closure duty cycle of said first switching device is proportional to the magnitude of a derivative of input signal current over time, and step (e) comprises controlling the rate of transfer of energy in step (d) so that the switch open duty cycle of said second switching device is proportional to the magnitude of a derivative of input signal current over time.

* * * * *